US011528932B2

(12) United States Patent
Sugyo et al.

(10) Patent No.: US 11,528,932 B2
(45) Date of Patent: Dec. 20, 2022

(54) FLAVOR-CONTAINING SHEET FOR SMOKING ARTICLE AND SMOKING ARTICLE COMPRISING THE SAME

(71) Applicant: JAPAN TOBACCO INC., Tokyo (JP)

(72) Inventors: Mitsuharu Sugyo, Tokyo (JP); Yasuo Tanaka, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 407 days.

(21) Appl. No.: 16/427,234

(22) Filed: May 30, 2019

(65) Prior Publication Data

US 2019/0274349 A1 Sep. 12, 2019

Related U.S. Application Data

(63) Continuation of application No. PCT/JP2016/085593, filed on Nov. 30, 2016.

(51) Int. Cl.

| | |
|---|---|
| ***A24B 15/16*** | (2020.01) |
| ***A24B 3/14*** | (2006.01) |
| ***A24B 15/14*** | (2006.01) |
| ***A24B 15/30*** | (2006.01) |
| ***A24C 5/01*** | (2020.01) |

(52) U.S. Cl.

CPC ..... *A24B 15/16* (2013.01); *A24B 3/14* (2013.01); *A24B 15/14* (2013.01); *A24B 15/30* (2013.01); *A24B 15/303* (2013.01); *A24C 5/01* (2020.01)

(58) Field of Classification Search

CPC ..... A24B 3/14; A24B 15/14; A24B 15/16; A24B 15/303

See application file for complete search history.

(56) References Cited

U.S. PATENT DOCUMENTS

| | | | | |
|---|---|---|---|---|
| 4,977,908 | A * | 12/1990 | Luke | A24B 3/14 131/375 |
| 5,562,108 | A | 10/1996 | Hardy et al. | |
| 2009/0038629 | A1* | 2/2009 | Ergle | A24B 15/283 131/276 |
| 2009/0221041 | A1* | 9/2009 | Aux | C12P 7/10 435/99 |
| 2011/0036367 | A1 | 2/2011 | Saito et al. | |
| 2011/0061667 | A1 | 3/2011 | Tanaka et al. | |
| 2013/0319430 | A1 | 12/2013 | Tanaka | |
| 2013/0327347 | A1 | 12/2013 | Tanaka et al. | |

FOREIGN PATENT DOCUMENTS

| | | | |
|---|---|---|---|
| AU | 2004200285 | B2 | 2/2004 |
| CN | 103501641 | A | 1/2014 |
| GB | 1 472 737 | A | 5/1977 |
| JP | 51-101176 | A | 9/1976 |

(Continued)

OTHER PUBLICATIONS

Office Action dated Aug. 30, 2020, in Republic of Korea Patent Application No. 10-2019-7014812.

(Continued)

*Primary Examiner* — Kelly M Gambetta
*Assistant Examiner* — Jennifer A Kessie
(74) *Attorney, Agent, or Firm* — Birch, Stewart, Kolasch & Birch, LLP

(57) ABSTRACT

A flavor-containing sheet for a smoking article, the sheet comprising a thickening polysaccharide, a flavor, an emulsifier, and a filler.

11 Claims, 6 Drawing Sheets

(56) References Cited

FOREIGN PATENT DOCUMENTS

| | | | |
|---|---|---|---|
| JP | 2013-99346 | A | 5/2013 |
| JP | 2015-42714 | A | 3/2015 |
| JP | 2016-189700 | A | 11/2016 |
| KR | 10-2010-0108614 | A | 10/2010 |
| KR | 10-1539157 | A | 7/2015 |
| TW | 201240613 | A1 | 10/2012 |
| TW | 201242523 | A1 | 11/2012 |
| WO | WO 2005/044026 | A1 | 5/2005 |
| WO | WO 2009/021018 | A1 | 2/2009 |
| WO | WO 2012/118032 | A1 | 9/2012 |
| WO | WO 2012/118033 | A1 | 9/2012 |
| WO | WO 2012/118034 | A1 | 9/2012 |

OTHER PUBLICATIONS

Office Action dated Apr. 13, 2020, in Taiwan Paten t Application No. 105140823.

Extended European Search Report for European Application No. 16923055.4, dated Jun. 9, 2020.

Taiwanese Office Action and Search Report dated Jul. 30, 2019, for corresponding Taiwanese Application No. 105140823, with English translation.

English translation of International Preliminary Report on Patentability and Written Opinion dated Jun. 13, 2019, in PCT/JP2016/085593 (Forms PCT/IB/326, PCT/IB/373, and PCT/ISA/237).

Office Action dated Mar. 2, 2021, in Chinese Patent Application No. 201680091222.6.

Office Action dated Apr. 7, 2021, in Republic of Korea Patent Application No. 10-2019-7014812.

International Search Report issued in PCT/JP2016/085593, dated Feb. 28, 2017.

Written Opinion of the International Searching Authority issued in PCT/JP2016/085593, dated Feb. 28, 2017.

* cited by examiner

FLAVOR-CONTAINING SHEET FOR SMOKING ARTICLE AND SMOKING ARTICLE COMPRISING THE SAME

CROSS-REFERENCE TO RELATED APPLICATIONS

This application is a Continuation Application of PCT Application No. PCT/JP2016/085593, filed Nov. 30, 2016, the entire contents of which are incorporated herein by reference.

BACKGROUND OF THE INVENTION

1. Field of the Invention

The present invention relates to a flavor-containing sheet for a smoking article, and a smoking article comprising the same.

2. Description of the Related Art

A flavor-containing sheet for a smoking article in which a flavor is dispersed in a non-volatile gelled matrix containing a thickening polysaccharide is known (see International Publication No. WO 2012/118032, International Publication No. WO 2012/118033, and International Publication No. WO 2012/118034). The flavor-containing sheet contains a flavor with the flavor being coated with the thickening polysaccharide, and therefore exhibits high storage stability of flavor. The flavor-containing sheet is prepared by extending, onto a substrate, a raw material slurry containing a thickening polysaccharide and a flavor, followed by drying. The prepared flavor-containing sheet is cut and used as a filler for a smoking article.

BRIEF SUMMARY OF THE INVENTION

The present inventors focused on the findings that when the cut pieces of the flavor-containing sheet contain the flavor at a low concentration, while there is a need to add a large amount of cut pieces to the smoking article to exhibit a desired flavor, the cut pieces can be uniformly distributed in the smoking article. Because of the uniform distribution of the cut pieces, the smoking article can be expected to provide a flavor in a stable manner during a smoking period.

According to this idea, the present inventors tried to prepare a flavor-containing sheet that contains a flavor at a low concentration. As a result, the problem occurred during preparation. Namely, when the concentration of the blended flavor was reduced based on the known composition of the raw material slurry, this resulted in the increase in the total amount of the raw material slurry required for preparing the sheet having a predetermined thickness, and as a result, the drying time increased (see Samples 1 and 2 of later-described Example 1).

In order to solve the problem, the decrease in the concentration of the blended flavor was supplemented with thickening polysaccharide, and as a result, the viscosity of the raw material slurry was increased, causing troubles in the kneading and emulsification processes of the raw material as well as the extension process of the raw material slurry (see Sample 3 of later-described Example 1). Therefore, an object of the present invention is to provide a technique capable of preparing a flavor-containing sheet in a stable manner under practical preparation conditions, even when the flavor-containing sheet has a composition in which a concentration of the blended flavor is low, and to provide the flavor-containing sheet.

The present inventors conducted studies to solve the problem. They found that a flavor-containing sheet including a filler can be prepared under practical preparation conditions even if the blending amount of the flavor is reduced, and accomplished the present invention.

That is, according to the first aspect of the present invention, there is provided a flavor-containing sheet for a smoking article, the sheet comprising a thickening polysaccharide, a flavor, an emulsifier, and a filler.

According to the second aspect of the present invention, there is provided a smoking article comprising cut pieces of the flavor-containing sheet for a smoking article.

According to the present invention, there are provided a flavor-containing sheet that may be prepared in a stable manner under practical preparation conditions even if the flavor-containing sheet has a composition in which a concentration of the blended flavor is low, and a smoking article comprising the same.

DETAILED DESCRIPTION OF THE INVENTION

Figure 1:
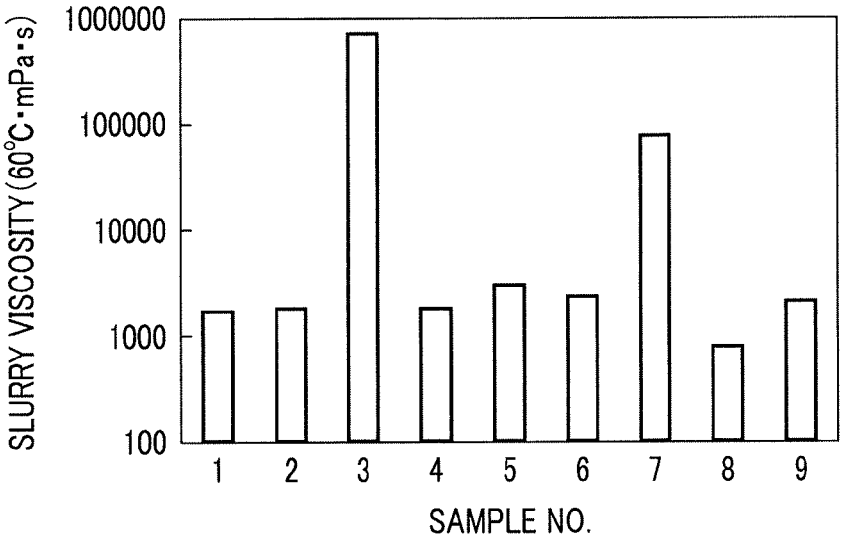
FIG. 1 is a graph showing the viscosity of the raw material slurry when types of the candidate filler are changed.

Hereinafter, the present invention will be described, but the following description is for the purpose of detailed explanation of the present invention, and is not intended to limit the present invention.

1. Flavor-Containing Sheet for Smoking Article

A flavor-containing sheet for a smoking article (hereinafter, also simply referred to as "flavor-containing sheet" or "sheet") of the present invention includes a thickening polysaccharide, a flavor, an emulsifier, and a filler.

The flavor-containing sheet can be prepared by kneading a raw material including the thickening polysaccharide, the flavor, the emulsifier, and the filler in water to prepare a raw material slurry, and extending the raw material slurry onto the substrate, followed by drying.

Each component of the flavor-containing sheet will be described below.

The thickening polysaccharide contained in the flavor-containing sheet has a property of fixing and coating a flavor dispersed in the sheet. Examples of the thickening polysaccharide include: a single-component system such as carrageenan, agar, xanthan gum, gellan gum, psyllium seed gum, or konjac glucomannan; or a combined system of a combination of two or more components selected from the group consisting of carrageenan, locust bean gum, guar gum, agar, gellan gum, tamarind gum, xanthan gum, tara gum, konjac glucomannan, starch, cassia gum, and psyllium seed gum.

Preferably, the thickening polysaccharide is a single-component system such as carrageenan, agar, xanthan gum, or gellan gum; or a combined system of a combination of carrageenan, agar, xanthan gum or gellan gum with at least one component selected from the group consisting of locust bean gum, guar gum, tamarind gum, tara gum, konjac glucomannan, cassia gum, and psyllium seed gum.

More preferably, the thickening polysaccharide is selected from the group consisting of carrageenan, agar, xanthan gum, gellan gum and a mixture of gellan gum and tamarind gum.

An aqueous solution of carrageenan, agar, xanthan gum or gellan gum has a property that once the solution is cooled to a specific temperature or less to form gel (that is, losing fluidity to be solidified), the solution is capable of maintaining the gel state without easily returning to a sol state even if the temperature is raised afterward to reach the gel transition temperature (hereinafter, referred to as "temperature responsive sol-gel transition property"). Therefore, if the raw material slurry contains any one of carrageenan, agar, xanthan gum and gellan gum as the thickening polysaccharide, there is an advantage that the sheet can be prepared in a short time by cooling the raw material slurry to form gel and then drying the gelled raw material at a high temperature.

More preferably, the thickening polysaccharide is selected from the group consisting of agar, gellan gum, and a mixture of gellan gum and tamarind gum.

If the mixture of gellan gum and tamarind gum is used as the thickening polysaccharide, the mass ratio of gellan gum and tamarind gum is preferably within a range of 1:1 to 3:1.

The blending amount of the thickening polysaccharide in the raw material slurry is preferably 10 to 35% by mass, more preferably 12 to 25% by mass, with respect to the total mass (i.e., dry matter mass) of the constituent components other than water in the raw material slurry. The blending amount (% by mass) of the thickening polysaccharide can be calculated using the values of the blending mass of the constituent components other than water in the raw material slurry.

A flavor contained in the flavor-containing sheet is not limited as long as it is used for a smoking article. Any type of flavor can be used. Main examples of the flavor include: menthol; leaf tobacco extract; natural plant flavors (e.g., cinnamon, sage, herb, chamomile, kudzu (*Pueraria lobata*), hydrangeae dulcis folium, clove, lavender, cardamom, caryophyllus, nutmeg, bergamot, geranium, honey essence, rose oil, lemon, orange, cassia bark, caraway, jasmine, ginger, coriander, vanilla extract, spearmint, peppermint, cassia, coffee, celery, cascarilla, sandalwood, cocoa, ylang-ylang, fennel, anise, licorice, St John's bread, prune extract, and peach extract); saccharides (e.g., glucose, fructose, isomerized saccharide, and caramel); cocoa (e.g., powder and extract); esters (e.g., isoamyl acetate, linalyl acetate, isoamyl propionate, and linalyl butyrate); ketones (e.g., menthone, ionone, damascenone, and ethyl maltol); alcohols (e.g., geraniol, linalool, anethole, and eugenol); aldehydes (e.g., vanillin, benzaldehyde, and anisaldehyde); lactones (e.g., γ-undecalactone and γ-nonalactone); animal flavors (e.g., musk, ambergris, civet, and castoreum); and hydrocarbons (e.g., limonene and pinene). These flavors may be used as solids, or may be used by being dissolved or dispersed in a suitable solvent such as propylene glycol, ethyl alcohol, benzyl alcohol, or triethyl citrate. A flavor which easily forms a dispersion state in a solvent by addition of an emulsifier, such as a hydrophobic flavor and oil-soluble flavor, may be preferably used. Such flavors may be used alone or in combination.

The content of the flavor in the sheet is preferably less than 18% by mass with respect to the total mass of the flavor-containing sheet. The content of the flavor in the sheet is more preferably 2.5% by mass or more and less than 18% by mass, still more preferably from 2.5 to 12% by mass, most preferably from 3 to 6% by mass, with respect to the total mass of the flavor-containing sheet. The content of the flavor in the sheet can be determined by the measuring method described in the later-described examples.

For an emulsifier contained in the flavor-containing sheet, any emulsifier may be used. For the emulsifier, for example, lecithin, specifically, SUN LECITHIN A-1 (Taiyo Kagaku Co., Ltd.), may be used.

The content of the emulsifier in the sheet is preferably from 0.5 to 5% by mass, more preferably from 1.0 to 4.5% by mass, with respect to the mass of the thickening polysaccharide in the sheet. The content of the emulsifier in the sheet can be calculated using values of the blending mass of the emulsifier and the thickening polysaccharide in the raw material slurry.

The filler contained in the flavor-containing sheet plays a role of increasing the total mass (i.e., dry matter mass) of the constituent components other than water in the raw material slurry and ultimately increasing the bulk of the flavor-containing sheet. That is, the filler serves only to increase the bulk of the flavor-containing sheet, and does not affect the original functions of the flavor-containing sheet. Specifically, the filler serves only to increase the bulk of the flavor-containing sheet, and satisfies the following requirements (i) and (ii):

(i) not substantially increasing the viscosity of the raw material slurry;

(ii) not adversely affecting the flavor retention function of the flavor-containing sheet.

A substance that increases the viscosity of raw material slurry, such as starch, is not included in the filler (see Sample 7 in Example 1 described later). Here, "not substantially increasing the viscosity of the raw material slurry" indicates not increasing the viscosity of the raw material slurry to the extent that preparation of the sheet becomes difficult (i.e., to the extent that kneading and emulsification processes of the raw material slurry become difficult). Also, "not adversely affecting the flavor retention function of the flavor-containing sheet" indicates not degrading the flavor retention function of the sheet to the extent that the original functions of the flavor-containing sheet (i.e., functions as a flavor component in the smoking article) are not exhibited.

The filler is, as a matter of course, a substance permitted in the art to be added to a smoking article as an additive.

Furthermore, for the filler, a substance that does not affect the smoking flavor of the smoking article is preferable (see "1-3. Smoking flavor" in Example 1 below). In addition, for the filler, a substance that does not adversely affect the sheet preparation process is preferable, for example, a substance that does not act to cause a significant shrinkage of the sheet in the drying process is preferable (see "1-2. Shrinkage rate of sheet" in Example 1 below).

The filler is preferably a starch hydrolysate. The starch hydrolysate refers to a substance obtained by a process including the step of hydrolyzing starch. The starch hydrolysate is, for example, a substance obtained by directly hydrolyzing starch (i.e., dextrin), or a substance obtained by hydrolyzing starch after heat treatment (i.e., indigestible dextrin).

The starch hydrolysate may be prepared by a process including a hydrolysis step using starch as a raw material, or a commercially available starch hydrolysate may be used. In case of preparing a starch hydrolysate, naturally-derived starch may be used for "starch" of a raw material. In general, plant-derived starch may be used, an example of which includes corn starch, wheat starch, potato starch, and sweet potato starch. Furthermore, a starch hydrolysate having a desired DE value may be obtained by controlling hydrolysis conditions.

The starch hydrolysate is generally a starch hydrolysate having a DE value within a range of 2 to 40, preferably a starch hydrolysate having a DE value within a range of 2 to 20. For a starch hydrolysate having a DE value within a range of 2 to 20, for example, Pinedex #100 (Matsutani Chemical Industry Co., Ltd.), Pinefiber (Matsutani Chemical Industry Co., Ltd.), and TK-16 (Matsutani Chemical Industry Co., Ltd.) may be used.

"DE" stands for dextrose equivalent, and a DE value is a value indicating the degree of hydrolysis of starch, that is, the saccharification rate of starch. In the present invention, the DE value is a value measured by the Willstatter-Schudel method. The DE value is measured as a specific numerical value by the Willstatter-Schudel method. The hydrolyzed starch (starch hydrolysate) has characteristics, such as characteristics of the molecular weight of the starch hydrolysate and the arrangement of the saccharide molecules constituting the starch hydrolysate, that are non-uniform for each molecule of the starch hydrolysate, and they exist with some distribution or variation. Depending on the distribution or variation of the characteristics of the starch hydrolysate or the difference in the section to be cut, the starch hydrolysate exhibits different physical property features (e.g., DE value) for each molecule. Thus, while the starch hydrolysate is an assembly of molecules that exhibit different physical property features, the result (i.e., DE value) measured by the Willstatter-Schudel method is handled as a representative value indicating the degree of hydrolysis of the starch.

More preferably, the starch hydrolysate is selected from the group consisting of dextrin having a DE value of 2 to 5, indigestible dextrin having a DE value of 10 to 15, and a mixture thereof. For dextrin having a DE value of 2 to 5, Pinedex #100 (Matsutani Chemical Industry Co., Ltd.) may be used, for example. For indigestible dextrin having a DE value of 10 to 15, Pinefiber (Matsutani Chemical Industry Co., Ltd.) may be used.

The filler may be added in an amount that can exert the filler's function of increasing the bulk of the sheet and that does not affect the smoking flavor of the smoking article. The content of the filler in the sheet is preferably from 100 to 500% by mass, more preferably from 200 to 500% by mass, with respect to the mass of the thickening polysaccharide. The content of the filler in the sheet can be calculated using the values of the blending mass of the filler and the thickening polysaccharide in the raw material slurry.

By adding the filler to the raw material of the flavor-containing sheet, even when the flavor-containing sheet has a composition in which a concentration of the blended flavor is low, it is possible to prepare the flavor-containing sheet in a stable manner under practical preparation conditions. Specifically, the filler plays a role of increasing the dry matter mass of the raw material slurry and increasing the bulk of the sheet, and this allows for shortening of the drying time required to prepare a sheet having a desired thickness. In addition, since the filler does not substantially increase the viscosity of the raw material slurry, no trouble is caused in the kneading process and extension process of the raw material slurry.

The flavor-containing sheet may contain water. That is, water contained in the raw material slurry may remain in the flavor-containing sheet after drying. When water is left in the flavor-containing sheet, the moisture content is preferably less than 10% by mass, more preferably from 3 to 9% by mass, still more preferably from 3 to 6% by mass, with respect to the total mass of the sheet. The moisture content of the sheet can be determined using GC-TCD as described below.

First, after the flavor-containing sheet is weighed, a predetermined amount of methanol (reagent of special grade or higher) is added and sealed, followed by shaking (at 200 rpm) for 40 minutes. The resulting mixture is left overnight, shaken again (at 200 rpm) for 40 minutes, and allowed to stand. The supernatant is used as a measurement solution.

The measurement solution is analyzed by GC-TCD and quantified by the calibration curve method. The conditions of GC-TCD may be set to, for example, the following conditions.

GC-TCD; 6890 gas chromatograph, manufactured by Hewlett Packard

Column; HP Polapack Q (packed column)

Constant Flow mode 20.0 mL/min

Injection; 1.0 μL

Inlet; EPC purge packed column inlet Heater; 230° C.

Gas; He Total flow; 21.1 mL/min

Oven; 160° C. (hold 4.5 min)→(60° C./min)→220° C. (hold 4.0 min)

Detector; TCD detector

Reference gas (He) flow rate; 20 mL/min

Make up gas (He) 3.0 mL/min

Signal rate; 5 Hz

The flavor-containing sheet may contain additional components, if necessary. For example, the flavor-containing sheet may contain a humectant. Examples of the humectant include glycerin, hyaluronic acid, and magnesium chloride. Further, the flavor-containing sheet may contain a colorant. For the colorant, cocoa, caramel, food additive dyes such as Blue No. 2, polyphenols such as chlorogenic acid, melanoidin, and the like, may be used.

The flavor-containing sheet has a thickness of, for example, from 0.05 to 0.15 mm, preferably, from 0.06 to 0.10 mm.

2. Preparation Method of Flavor-Containing Sheet

The flavor-containing sheet may be prepared by, according to the known technique, kneading the raw material including the thickening polysaccharide, the flavor, the emulsifier, and the filler in water to prepare a raw material slurry, and extending the raw material slurry onto the substrate, followed by drying.

The composition of the raw material slurry may be, for example, 350 to 500 g of the thickening polysaccharide, 400 to 600 g of the flavor, 10 to 20 g of the emulsifier, and 1000 to 2000 g of the filler, for 10 L of water. Kneading of the raw material can be carried out by the known emulsification technique using a homogenizer while heating to 60 to 100° C. The obtained raw material slurry has a viscosity of, for example, 10,000 [mPa·s/60° C.] or less, preferably 1,000 to 10,000 [mPa·s/60° C.], more preferably 1,000 to 5,000 [mPa·s/60° C.]

The obtained raw material slurry can be extended on a substrate so that the thickness of the sheet obtained after drying is, for example, about 0.05 to 0.15 mm. Thereafter, the raw material slurry is dried until reaching the desired moisture content.

As described above, if the raw material slurry contains a thickening polysaccharide having temperature-responsive sol-gel transition property, it is possible to cool the raw material slurry extended on the substrate to a sample temperature of 0 to 40° C. to form gel followed by heat-drying the gelled raw material at a sample temperature of 70 to 100° C. In this case, once the aqueous solution of the thickening polysaccharide forms gel, it does not easily return to a sol state even if the temperature is raised afterward to reach the gel transition temperature, and therefore it is possible to perform heat-drying at a high temperature and to shorten the drying time.

3. Smoking Article

The flavor-containing sheet of the present invention can be cut into a size equivalent to ordinary cut tobacco, for example, and the obtained cut pieces can be incorporated in any smoking article.

Specifically, the flavor-containing sheet can be incorporated into: a combustion type smoking article, such as a cigarette, that burns a tobacco filler; or a non-combustion type smoking article, such as a heating type inhalation article, that does not burn a tobacco filler. Examples of the heating type inhalation article include: a carbonaceous heat source type inhalation article that heats a tobacco filler with combustion heat of a carbon heat source (see, for example, WO 2006/073065); an electrical heating type inhalation article provided with an inhaler and a heating device for electrically heating the inhaler (see, for example, WO 2010/110226); and a liquid atomization type inhalation article that atomizes, by heating, a liquid aerosol source containing a smoking flavor source (see, for example, WO2015/046385).

That is, according to another aspect, there is provided a smoking article including cut pieces of the flavor-containing sheet of the present invention. Specifically, there is provided a smoking article including cut tobacco and cut pieces of the flavor-containing sheet of the present invention mixed with the cut tobacco.

Preferably, the cut pieces of the flavor-containing sheet are cut pieces of a flavor-containing sheet having a thickness of from 0.05 to 0.15 mm, preferably from 0.06 to 0.10 mm, and the cut pieces each have a long side of from 2.0 to 7.0 mm and a short side of from 0.5 to 2.0 mm.

Preferably, the cut pieces of the flavor-containing sheet are contained in the smoking article in an amount of 4 to 20% by mass with respect to the total mass of the cut tobacco and the cut pieces. If the cut pieces are blended in the smoking article in an amount of 4% by mass or more with respect to the total mass of the cut tobacco and the cut pieces, it is possible to suppress variations in the distribution of the flavor in the smoking article.

4. Preferred Embodiment

According to a preferred embodiment, the flavor-containing sheet contains a flavor at a low concentration. If the flavor-containing sheet contains a flavor at a low concentration, it is necessary to add a large amount of cut pieces of the flavor-containing sheet to the smoking article in order to exhibit a desired flavor by adding the cut pieces of the flavor-containing sheet to the smoking article. In this case, since a large amount of cut pieces of the flavor-containing sheet is added to the smoking article, the cut pieces can be distributed uniformly in the smoking article. Owing to the uniform distribution of the cut pieces, such a smoking article has the advantage that the flavor can be provided in a stable manner during the smoking period.

Meanwhile, if the flavor-containing sheet which contains a flavor at a low concentration is prepared based on the known composition of the raw material slurry, the dry matter mass of the raw material slurry will be small; thus, in order to prepare a sheet having a predetermined thickness, the required total amount of the raw material slurry will increase, thereby leading to the problem of the increased drying time. In a preferred embodiment, such a preparation problem is solved by adding a filler to the raw material of the flavor-containing sheet, and as a result, it is possible to prepare a sheet having a predetermined thickness and containing a flavor at a low concentration.

Preferable embodiments of the flavor-containing sheet are specifically described below.

[1A] A flavor-containing sheet for a smoking article, the sheet comprising a thickening polysaccharide, a flavor, an emulsifier, and a filler, wherein a content of the flavor is less than 18% by mass with respect to the flavor-containing sheet.

[2A] The flavor-containing sheet according to [1A], wherein the content of the flavor is 2.5% by mass or more and less than 18% by mass, preferably from 2.5 to 12% by mass, more preferably from 3 to 6% by mass, with respect to the flavor-containing sheet.

[3A] The flavor-containing sheet according to [1A] or [2A], wherein the filler is a starch hydrolysate.

[4A] The flavor-containing sheet according to [3A], wherein the starch hydrolysate is a starch hydrolysate having a DE value within a range of 2 to 40, preferably a DE value within a range of 2 to 20.

[5A] The flavor-containing sheet according to [4A], wherein the starch hydrolysate is selected from the group consisting of dextrin having a DE value of 2 to 5, indigestible dextrin having a DE value of 10 to 15, and a mixture thereof.

[6A] The flavor-containing sheet according to any one of [1A] to [5A], wherein a content of the filler is 100 to 500% by mass, preferably 200 to 500% by mass, with respect to the thickening polysaccharide.

[7A] The flavor-containing sheet according to any one of [1A] to [6A], wherein the flavor-containing sheet has a thickness of 0.05 to 0.15 mm, preferably 0.06 to 0.10 mm.

[8A] The flavor-containing sheet according to any one of [1A] to [7A], wherein the thickening polysaccharide is a single-component system of carrageenan, agar, xanthan gum, or gellan gum; or a combined system of a combination of carrageenan, agar, xanthan gum or gellan gum with at least one component selected from the group consisting of locust bean gum, guar gum, tamarind gum, tara gum, konjac glucomannan, cassia gum, and psyllium seed gum.

[9A] The flavor-containing sheet according to any one of [1A] to [7A], wherein the thickening polysaccharide is selected from the group consisting of carrageenan, agar, xanthan gum, gellan gum and a mixture of gellan gum and tamarind gum.

[10A] The flavor-containing sheet according to any one of [1A] to [7A], wherein the thickening polysaccharide is selected from the group consisting of gellan gum, a mixture of gellan gum and tamarind gum, and agar.

[11A] The flavor-containing sheet according to any one of [1A] to [10A], wherein a blending amount of the thickening polysaccharide in a raw material is 10 to 35% by mass, preferably 12 to 25% by mass, with respect to a total mass of constituent components other than water in the raw material of the flavor-containing sheet.

[12A] The flavor-containing sheet according to any one of [1A] to [11A], wherein a content of the emulsifier is 0.5 to 5% by mass, preferably 1.0 to 4.5% by mass, with respect to the thickening polysaccharide.

[13A] The flavor-containing sheet according to any one of [1A] to [12A], comprising water in an amount of less than 10% by mass, preferably from 3 to 9% by mass, more preferably from 3 to 6% by mass, with respect to the flavor-containing sheet.

Preferable embodiments of the smoking article are specifically described below.

[1B] A smoking article comprising cut pieces of the flavor-containing sheet according to any one of [1A] to [13A].

[2B] The smoking article according to [1B], wherein the article further comprises a cut tobacco, and the cut pieces of the flavor-containing sheet are mixed with the cut tobacco.

[3B] The smoking article according to [2B], wherein the cut pieces are cut pieces of the flavor-containing sheet according to any one of [1A] to [13A] having a thickness of 0.05 to 0.15 mm, preferably 0.06 to 0.10 mm, and the cut pieces each have a long side of 2.0 to 7.0 mm and a short side of 0.5 to 2.0 mm.

[4B] The smoking article according to [2B] or [3B], wherein the cut pieces are contained in an amount of 4 to 20% by mass with respect to a total mass of the cut tobacco and the cut pieces.

[5B] The smoking article according to any one of [1B] to [4B], wherein the smoking article is a combustion type smoking article, preferably a cigarette.

[6B] The smoking article according to any one of [1B] to [4B], wherein the smoking article is a non-combustion type smoking article, preferably a heating type inhalation article, more preferably a carbonaceous heat source type inhalation article, an electrical heating type inhalation article, or a liquid atomization type inhalation article.

Preferable embodiments of the method of preparing the flavor-containing sheet are specifically described below.

[1C] A method of preparing a flavor-containing sheet for a smoking article, the method comprising:

extending the raw material slurry including a thickening polysaccharide, a flavor, an emulsifier, a filler and water onto the substrate; and drying the extended raw material, wherein a content of the flavor in the flavor-containing sheet is less than 18% by mass with respect to the flavor-containing sheet.

[2C] A method of preparing a flavor-containing sheet for a smoking article, the method comprising:

extending the raw material slurry including a thickening polysaccharide, a flavor, an emulsifier, a filler and water and having a temperature of 60 to 90° C. onto the substrate, wherein the thickening polysaccharide is a single-component system of carrageenan, agar, xanthan gum, or gellan gum; or a combined system of a combination of carrageenan, agar, xanthan gum or gellan gum with at least one component selected from the group consisting of locust bean gum, guar gum, tamarind gum, tara gum, konjac glucomannan, cassia gum, and psyllium seed gum;

cooling the extended raw material slurry to a sample temperature of 0 to 40° C. to form a gel; and heat-drying the gelled raw material at a sample temperature of 70 to 100° C., wherein a content of the flavor in the flavor-containing sheet is less than 18% by mass with respect to the flavor-containing sheet.

[3C] The method according to [2C], wherein the thickening polysaccharide is selected from the group consisting of carrageenan, agar, xanthan gum, gellan gum and a mixture of gellan gum and tamarind gum.

[4C] The method according to [2C], wherein the thickening polysaccharide is selected from the group consisting of gellan gum, a mixture of gellan gum and tamarind gum, and agar.

[5C] The method according to any one of [1C] to [4C], wherein the content of the flavor in the flavor-containing sheet is 2.5% by mass or more and less than 18% by mass, preferably from 2.5 to 12% by mass, more preferably from 3 to 6% by mass, with respect to the flavor-containing sheet.

[6C] The method according to any one of [1C] to [5C], wherein the filler is a starch hydrolysate.

[7C] The method according to [6C], wherein the starch hydrolysate is a starch hydrolysate having a DE value within a range of 2 to 40, preferably a DE value within a range of 2 to 20.

[8C] The method according to [7C], wherein the starch hydrolysate is selected from the group consisting of dextrin having a DE value of 2 to 5, indigestible dextrin having a DE value of 10 to 15, and a mixture thereof.

[9C] The method according to any one of [1C] to [8C], wherein a content of the filler in the flavor-containing sheet is 100 to 500% by mass, preferably 200 to 500% by mass, with respect to the thickening polysaccharide.

[10C] The method according to any one of [1C] to [9C], wherein the flavor-containing sheet has a thickness of 0.05 to 0.15 mm, preferably 0.06 to 0.10 mm.

[11C] The method according to any one of [1C] to [10C], wherein a blending amount of the thickening polysaccharide in a raw material is 10 to 35% by mass, preferably 12 to 25% by mass, with respect to a total mass of constituent components other than water in the raw material of the flavor-containing sheet.

[12C] The method according to any one of [1C] to [11C], wherein a content of the emulsifier in the flavor-containing sheet is 0.5 to 5% by mass, preferably 1.0 to 4.5% by mass, with respect to the thickening polysaccharide.

[13C] The method according to any one of [1C] to [12C], wherein the drying is performed until the flavor-containing sheet has a moisture content of less than 10% by mass, preferably from 3 to 9% by mass, more preferably from 3 to 6% by mass.

EXAMPLES

Example 1

In this example, the flavor-containing sheet was prepared using the candidate substance for the filler (hereinafter, referred to as "candidate filler"), and the evaluation was conducted on how the candidate filler affects the following four evaluation items, "1-1. Viscosity of raw material slurry", "1-2. Shrinkage rate of sheet", "1-3. Smoking flavor", and "1-4. Flavor retention rate after storage". In Example 1, for the thickening polysaccharide, gellan gum and tamarind gum were used at a mass ratio of 1:1.

1-1. Viscosity of Raw Material Slurry (1) Preparation of Raw Material Slurry

[Sample 1]

Sample 1 corresponds to Example 1 disclosed in Patent Literatures 1 to 3.

[Composition]

Water: 100 parts by mass

Deacylated type gellan gum (KELCOGEL; CP Kelco): 2.5 parts by mass

Tamarind gum (TG-120; MRC Polysaccharide Co., Ltd.): 2.5 parts by mass

Lecithin (SUN LECITHIN A-1; Taiyo Kagaku Co., Ltd.): 0.1 parts by mass

L-menthol (special grade reagent; Wako Pure Chemical Industries, Ltd.): 12.5 parts by mass

[Procedure]

Deacylated type gellan gum, tamarind gum, and lecithin were dissolved in 0.3 L of water heated and kept at about 70° C. to prepare a polysaccharide solution. L-menthol was added to the polysaccharide solution and the mixture was kneaded and emulsified with a homogenizer (DMM type; ATEC Japan) to prepare a raw material slurry.

[Sample 2]

For Sample 2, the blending amount of the flavor was reduced based on the composition of Sample 1.

[Composition]

Water: 100 parts by mass

Deacylated type gellan gum (KELCOGEL; CP Kelco): 2.5 parts by mass

Tamarind gum (TG-120; MRC Polysaccharide Co., Ltd.): 2.5 parts by mass

Lecithin (SUN LECITHIN A-1; Taiyo Kagaku Co., Ltd.): 0.1 parts by mass

L-menthol (special grade reagent; Wako Pure Chemical Industries, Ltd.): 0.13 parts by mass

[Procedure]

A raw material slurry was prepared by the same procedure as Sample 1.

[Sample 3]

For Sample 3, the blending amount of the flavor was reduced based on the composition of Sample 1, and the reduced flavor was supplemented with thickening polysaccharide.

[Composition]

Water: 100 parts by mass

Deacylated type gellan gum (KELCOGEL; CP Kelco): 8.5 parts by mass

Tamarind gum (TG-120; MRC Polysaccharide Co., Ltd.): 8.5 parts by mass

Lecithin (SUN LECITHIN A-1; Taiyo Kagaku Co., Ltd.): 0.34 parts by mass

L-menthol (special grade reagent; Wako Pure Chemical Industries, Ltd.): 0.43 parts by mass

[Procedure]

A raw material slurry was prepared by the same procedure as Sample 1.

[Sample 4]

For Sample 4, granulated sugar (flavor grade) was added as a candidate filler.

[Composition]

Water: 100 parts by mass

Deacylated type gellan gum (KELCOGEL; CP Kelco): 2.5 parts by mass

Tamarind gum (TG-120; MRC Polysaccharide Co., Ltd.): 2.5 parts by mass

Lecithin (SUN LECITHIN A-1; Taiyo Kagaku Co., Ltd.): 0.1 parts by mass

Candidate filler: 12.0 parts by mass

L-menthol (special grade reagent; Wako Pure Chemical Industries, Ltd.): 0.45 parts by mass

[Procedure]

Deacylated type gellan gum, tamarind gum, and lecithin were dissolved in 0.3 L of water heated and kept at about 70° C. to prepare a polysaccharide solution. After the candidate filler was added to the polysaccharide solution, 1-menthol was added and the mixture was kneaded and emulsified with a homogenizer (DMM type; ATEC Japan) to prepare a raw material slurry.

[Sample 5]

For Sample 5, a raw material slurry was prepared with the same composition and by the same procedure as Sample 4, except that cellulose (cellulose microcrystalline; Sigma-Aldrich) was used as a candidate filler.

[Sample 6]

For Sample 6, a raw material slurry was prepared with the same composition and by the same procedure as Sample 4, except that calcium carbonate (special grade reagent; Wako Pure Chemical Industries, Ltd.) was used as a candidate filler.

[Sample 7]

For Sample 7, a raw material slurry was prepared with the same composition and by the same procedure as Sample 4, except that starch (reagent derived from corn; Wako Pure Chemical Industries, Ltd.) was used as a candidate filler.

[Sample 8]

For Sample 8, a raw material slurry was prepared with the same composition and by the same procedure as Sample 4, except that Pinedex #100 (dextrin having a DE value of 2 to 5; Matsutani Chemical Industry Co., Ltd.) was used as a candidate filler.

[Sample 9]

For Sample 9, a raw material slurry was prepared with the same composition and by the same procedure as Sample 4, except that Pinefiber (indigestible dextrin having a DE value of 10 to 15; Matsutani Chemical Industry Co., Ltd.) was used as a candidate filler.

(2) Preparation of Flavor-Containing Sheet

Using the raw material slurry of each of Samples 4 to 9, a flavor-containing sheet was prepared in the following manner.

The raw material slurry was extended to have a thickness of 1.0 mm on a stainless steel plate wrapped with Saran Wrap (registered trademark). The extended raw material slurry was once cooled to a sample temperature of 20° C. to form gel. Thereafter, hot air of about 100° C. generated by a hot air generator (New Hot Blaster MS 5841-6D; set temperature: about 140° C.; Miyamoto Seisakusho Co., Ltd.) was applied to the gelled raw material for about 10 minutes to dry the raw material. In this manner, the flavor-containing sheet (thickness: about 0.1 mm) was prepared.

The flavor contents of the flavor-containing sheets of Samples 4 to 9 were measured by the later-described method, and they were, respectively, 0.08% by mass, 0.94% by mass, 0.04% by mass, by mass, ≈0% by mass, and ≈0% by mass, with respect to the sheet.

(3) Viscosity Measurement of Raw Material Slurry

The viscosity of the raw material slurry of each of Samples 1 to 9 was measured with a rheometer (RheoStrees-1; Thermo Haake) in the following manner.

The viscosity of the raw material slurry was evaluated by complex viscosity. Details of the measurement conditions are as follows.

Rheometer; RheoStrees-1, Thermo Haake

Sensor; 60 mm dia. plate-plate (gap; 1.0 mm)

Amplitude condition; Control Stress mode (5 Pa) 1 Hz

Temperature condition; 80° C.→20° C. (temperature decrease)/20° C.→80° C. (temperature increase) (3° C./min each)

In order to eliminate the influence of film formation by drying from the side of the sample during viscosity measurement operation, the side of the sample was sealed with silicone oil (KF-50-1000CS; Shin-Etsu Chemical Co., Ltd.).

(4) Results

The results of the viscosity measurement are shown in FIG. 1.

For the raw material slurry of Sample 2, while the blending amount of the flavor was reduced based on the composition of the raw material slurry of Sample 1, the raw material slurry of Sample 2 had a viscosity to the extent that emulsification process and extension process can be carried out without problems in a manner similar to Sample 1. However, the attempt to prepare a flavor-containing sheet having a predetermined thickness with the raw material slurry of Sample 2 ended up increasing the total amount of the raw material slurry necessary to prepare a sheet having a predetermined thickness. This led to the problem of the increased drying time.

In order to solve the problems, in Sample 3, the decrease in the concentration of the blended flavor was supplemented with thickening polysaccharide, and as a result, the viscosity of the raw material slurry was increased, causing the impediments to the kneading and emulsification processes of the raw material as well as in the extension process of the raw material slurry.

For Samples 4 to 9, the decrease in the concentration of the blended flavor was supplemented with the candidate filler. For Samples 4, 5, 6, 8, and 9, granulated sugar, cellulose, calcium carbonate, dextrin, and indigestible dextrin were used, respectively, as the candidate fillers. As a result, the raw material slurry had a viscosity to the extent that emulsification process and extension process could be carried out without problems. In addition, the flavor-containing sheet was prepared using the raw material slurry of each of Samples 4 to 9. As a result, the candidate filler played a role of increasing the bulk of the sheet, and therefore it was possible to shorten the drying time required to prepare a sheet having a predetermined thickness and containing a flavor at a low concentration.

1-2. Shrinkage Rate of Sheet (1) Preparation of Flavor-Containing Sheet

The raw material slurry of each of Samples 4 to 9 was extended and dried as described above to prepare a flavor-containing sheet. As for Sample 7, the viscosity of the raw material slurry increased, and it was not possible to extend the raw material slurry to have a uniform thickness; thus, Sample 7 was excluded from the evaluation subject.

(2) Measurement of Shrinkage Rate

The length of one side of the extended raw material slurry, and the length of one side of the flavor-containing sheet immediately after preparation, were measured. From the measured values, the shrinkage rate was obtained by the following equation.

$$\text{Shrinkage rate (\%)}=[\{(\text{length of one side of extended raw material slurry})-(\text{length of one side of flavor-containing sheet immediately after preparation})\}/(\text{length of one side of extended raw material slurry})]\times 100$$

(3) Results

Figure 2:
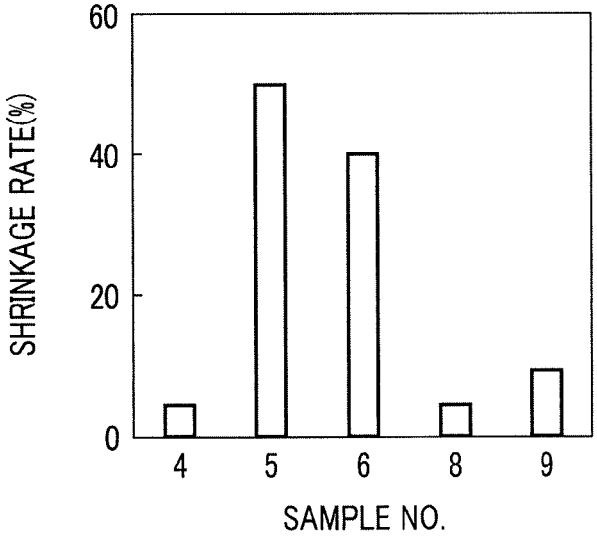
FIG. 2 is a graph showing the shrinkage rate of the flavor-containing sheet when types of the candidate filler are changed.

The measurement results of the shrinkage rate are shown in FIG. 2.

Sample 4 (candidate filler: granulated sugar), Sample (candidate filler: dextrin), and Sample 9 (candidate filler: indigestible dextrin) each had a low shrinkage rate, and therefore they are considered to have high manufacturing suitability.

Sample 6 (candidate filler: calcium carbonate) had a shrinkage rate of about 40%. This shrinkage rate does not adversely affect the preparation of the sheet, and is a permissible range from the viewpoint of manufacturing suitability.

On the other hand, Sample 5 (candidate filler: cellulose) had the highest shrinkage rate of about 50%.

1-3. Smoking Flavor (1) Preparation of Flavor-Containing Sheet

Depending on the types of the candidate filler, there was a difference in the yield of the flavor (i.e., the ratio of the content of the flavor in the prepared sheet to the blending amount of the flavor). Therefore, in this experiment, the flavor-containing sheets of Samples 10 to 15 were each prepared by adjusting the blending amount of the flavor for each candidate filler so that the flavor-containing sheet contained about 2.5%; by mass of the flavor.

[Sample 10]

For Sample 10, granulated sugar (flavor grade) was used as a candidate filler.

[Composition]

Water: 100 parts by mass

Deacylated type gellan gum (KELCOGEL; CP Kelco): 2.5 parts by mass

Tamarind gum (TG-120; MRC Polysaccharide Co., Ltd.): 2.5 parts by mass

Lecithin (SUN LECITHIN A-1; Taiyo Kagaku Co., Ltd.): 0.1 parts by mass

Candidate filler: 10.4 parts by mass

L-menthol (special grade reagent; Wako Pure Chemical Industries, Ltd.): 0.6 parts by mass

[Procedure]

Deacylated type gellan gum, tamarind gum, and lecithin were dissolved in 0.3 L of water heated and kept at about 70° C. to prepare a polysaccharide solution. After the candidate filler was added to the polysaccharide solution, 1-menthol was added and the mixture was kneaded and emulsified with a homogenizer (DMM type, ATEC Japan) to prepare a raw material slurry.

The prepared raw material slurry was extended to have a thickness of 1.0 mm on a stainless steel plate wrapped with Saran Wrap (registered trademark). The extended raw material slurry was once cooled to a sample temperature of 20° C. to form gel. Thereafter, hot air of about 100° C. generated by a hot air generator (New Hot Blaster MS 5841-6D; Miyamoto Seisakusho Co., Ltd.) was applied to the gelled raw material for about 10 minutes to dry the raw material. In this manner, the flavor-containing sheet (thickness: 0.1 mm) was prepared.

The flavor content of the prepared flavor-containing sheet was 2.2% by mass with respect to the sheet.

[Sample 11]

For Sample 11, a flavor-containing sheet was prepared with the same composition and by the same procedure as Sample 10, except that cellulose (cellulose microcrystalline; Sigma-Aldrich) was used as a candidate filler and that the blending amount of the flavor was changed to 2.7 parts by mass. The flavor content of the prepared flavor-containing sheet was 3.7% by mass with respect to the sheet.

[Sample 12]

For Sample 12, a flavor-containing sheet was prepared with the same composition and by the same procedure as Sample 10, except that calcium carbonate (special grade reagent; Wako Pure Chemical Industries, Ltd.) was used as a candidate filler and that the blending amount of the flavor was changed to 3.4 parts by mass. The flavor content of the prepared flavor-containing sheet was 3.7% by mass with respect to the sheet.

[Sample 13]

For Sample 13, a flavor-containing sheet was prepared with the same composition and by the same procedure as Sample 10, except that starch (reagent derived from corn; Wako Pure Chemical Industries, Ltd.) was used as a candidate filler and that the blending amount of the flavor was changed to 3.9 parts by mass. The flavor content of the prepared flavor-containing sheet was 1.9% by mass with respect to the sheet.

[Sample 14]

For Sample 14, a flavor-containing sheet was prepared with the same composition and by the same procedure as Sample 10, except that Pinedex #100 (Matsutani Chemical Industry Co., Ltd.) was used as a candidate filler and that the blending amount of the flavor was changed to 3.9 parts by mass. The flavor content of the prepared flavor-containing sheet was 2.5% by mass with respect to the sheet.

[Sample 15]

For Sample 15, a flavor-containing sheet was prepared with the same composition and by the same procedure as Sample 10, except that Pinefiber (Matsutani Chemical Industry Co., Ltd.) was used as a candidate filler and that the blending amount of the flavor was changed to 16.1 parts by mass. The flavor content of the prepared flavor-containing sheet was 3.96% by mass with respect to the sheet.

(2) Preparation of Cigarette

Using the flavor-containing sheets of Samples 10 to 15, cigarettes were prepared as follows.

The flavor-containing sheet (thickness 0.1 mm) of Sample 10 was cut to obtain cut pieces each having a long side of 4 mm and a short side of 1.5 mm. The cut pieces were mixed with cut tobacco taken from the Winston Tar 12 mg product (Japan Tobacco Inc.) (hereinafter, referred to as "control cigarette") at a mass ratio of 5:95 to obtain mixed cut tobacco. The mixed cut tobacco was rewrapped with a cigarette paper to prepare a cigarette of Sample 10.

Using the flavor-containing sheets of Samples 11 to 15, cigarettes of Samples 11 to 15 were prepared in the similar manner.

(3) Sensory Evaluation of Smoking Flavor

The smoking flavor of each of the cigarettes of Samples 10 to 15 was evaluated by sensory evaluation. Specifically, the evaluation was conducted on the extent to which the smoking flavor of each of the cigarettes of Samples 10 to 15 had changed in comparison to the smoking flavor of the control cigarette.

Eight panelists trained in evaluating the smoking flavors smoked the control cigarette and the cigarettes of Samples 10 to 15 with the lot names hidden, and scored 1 to 5 which reflected the extent of the change in the smoking flavor from that of the control cigarette.

(Scoring Criteria)

1: smoking flavor changed significantly

2: smoking flavor changed considerably

3: smoking flavor changed

4: smoking flavor changed slightly

5: smoking flavor equal with no change

The scores provided by the eight panelists were averaged, the average value was rounded to one decimal place, and the obtained value was taken as the evaluation score of each cigarette.

(4) Results

The evaluation scores are shown in Table 1 below.

TABLE 1

| Sample No. | Candidate Filler | Score |
|---|---|---|
| 10 | Granulated Sugar | 2 |
| 11 | Cellulose | 2 |
| 12 | Calcium Carbonate | 1 |
| 13 | Starch | 3 |
| 14 | Pinedex | 4 |
| 15 | Pinefiber | 5 |

As shown in Table 1, the cigarettes of Samples 14 and 15 demonstrated little or no change in the smoking flavor from that of the control cigarette.

The cigarettes of Samples 10 and 11 demonstrated a smoking flavor which had changed considerably from that of the control cigarette. The cigarette of Sample 10 had a sweet smoking flavor. The cigarette of Sample 11 had a smoking flavor weaker than that of the control cigarette. However, this change in the cigarette of Sample 10 is not an adverse effect depending on the concept of the smoking flavor of the cigarette.

The cigarette of Sample 12 demonstrated a smoking flavor which had changed significantly from that of the control cigarette, and had a smoking flavor weaker than that of the control cigarette. The cigarette of Sample 13 demonstrated a smoking flavor which had changed from that of the control cigarette, while the change was smaller than those demonstrated by the cigarettes of Samples 10 and 11.

1-4. Flavor Retention Rate after Storage (1) Preparation of Flavor-Containing Sheet The flavor-containing sheets of Samples 10 to 15 were prepared as described above.

(2) Storage Test

The prepared flavor-containing sheet was cut into a size of 1×10 mm to obtain cut pieces. The obtained cut pieces were spread on a sample dish, and stored for predetermined periods (7 days, 14 days, and 30 days) in a constant temperature apparatus (DX 600; Yamato Scientific, Co., Ltd.) set at 50° C. The flavor content of each sample after storage was measured.

(3) Measurement of Flavor Content

Menthol contained in the flavor-containing sheet immediately after preparation (0 day of storage) and the flavor-containing sheets stored for 7, 14 and 30 days was extracted with methanol to prepare a measurement solution. Menthol in the measurement solution was quantified by GC-MSD.

10 mL of methanol (reagent of special grade or higher) was added to 0.1 g of the cut pieces of the stored flavor-containing sheet in a closed container (screw tube) of 50 mL capacity, followed by shaking (at 200 rpm) for 40 minutes.

The resulting mixture was left overnight, shaken again (at 200 rpm) for 40 minutes, and allowed to stand. After standing, the supernatant was diluted at a dilution concentration suitable for GC measurement (here, Δ1 to ×10 methanol dilution) to prepare a measurement solution. Methanol used for preparing the measurement solution contains 1,3-butanediol (special grade reagent; Wako Pure Chemical Industries, Ltd.) as an internal standard substance at a concentration of 0.05 mg/mL.

Menthol in the measurement solution prepared as described above was quantified by the following GC-MSD and the calibration curve method.

GC-MSD; 6890N gas chromatograph, manufactured by Agilent

Column; DB-1 60 m×320 μm (1 μm)

Constant velocity mode 30 cm/sec

Oven; 40° C.→(5° C./min)→250° C. (hold 5 min)

Injection; 1 μL

Insert liner; Agilent 4711 (250° C.)

Inlet; Sprit mode 10:1 14 mL/min 5973 inert mass spectrometer manufactured by Agilent Scan mode (30 to 300 amu·2.74 scans/sec)

Concentration of calibration curve solutions; 8 points of 0, 0.01, 0.05, 0.1, 0.3, 0.5, 0.7, and 1.0 [mg-menthol/mL]

The flavor retention rate of each sample was calculated from the measurement value of the flavor content using the following equation.

Flavor retention rate=(flavor content of flavor-containing sheet after storage)/(flavor content of flavor-containing sheet immediately after preparation)

(4) Results

Figure 3:
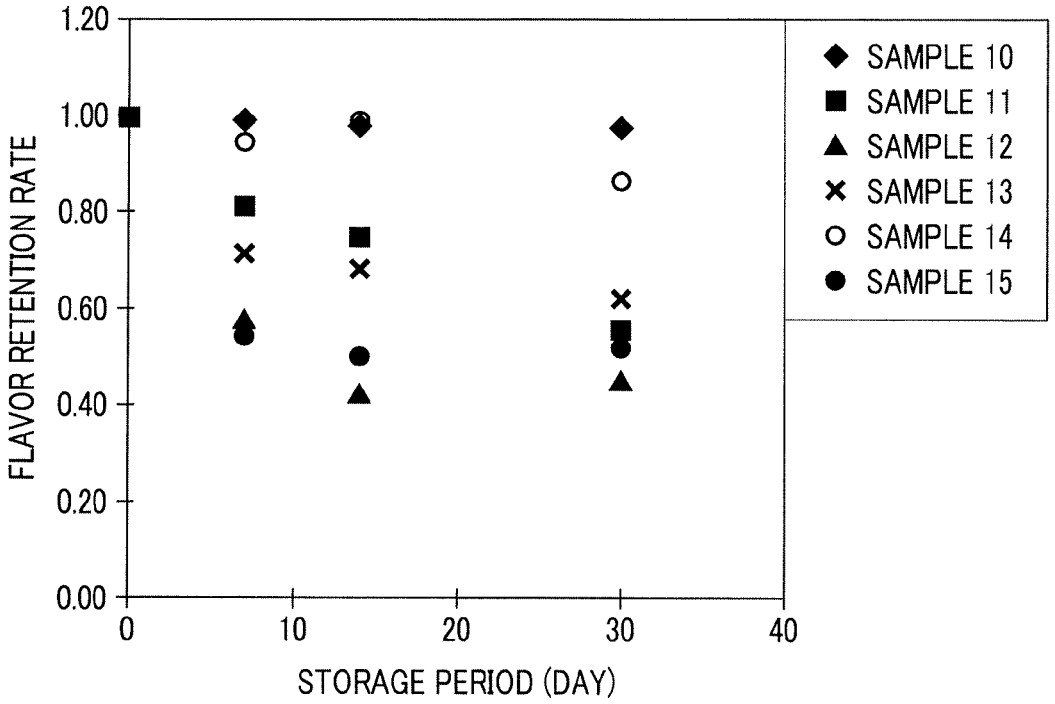
FIG. 3 is a graph showing the flavor retention rate of the flavor-containing sheet when types of the candidate filler are changed.

The results of the flavor retention rate are shown in FIG. 3.

Based on the flavor retention rate of the flavor-containing sheet stored for 30 days, the evaluation score was given according to the following scoring criteria. The evaluation results are shown in the following table.

TABLE 2

| Sample No. | Candidate Filler | Score |
|---|---|---|
| 10 | Granulated Sugar | 4 |
| 11 | Cellulose | 3 |
| 12 | Calcium Carbonate | 2 |
| 13 | Starch | 3 |
| 14 | Pinedex | 4 |
| 15 | Pinefiber | 3 |

(Scoring Criteria)

Flavor retention rate of 0.75 or more and 1.00 or less: Evaluation score 4

Flavor retention rate of 0.50 or more and less than 0.75: Evaluation score 3

Flavor retention rate of 0.25 or more and less than 0.50: Evaluation score 2

Flavor retention rate of 0 or more and less than 0.25: Evaluation score 1

From the results shown in FIG. 3 and Table 2, for Samples 10, 11, 13, 14 and 15, the flavor retention rates of the flavor-containing sheets stored for 30 days were 0.5 or more. In particular, for Samples 10 and 14, the flavor retention rates of the flavor-containing sheets were high as 0.75 or more. On the other hand, for Sample 12, the flavor retention rate of the flavor-containing sheet was less than 0.5.

1-5. Summary

According to the experiments described above, the evaluation was conducted on how the candidate filler affects the following four evaluation items, "1-1. Viscosity of raw material slurry", "1-2. Shrinkage rate of sheet", "1-3. Smoking flavor", and "1-4. Flavor retention rate after storage". The evaluation results are summarized in Table 3.

TABLE 3

| Candidate Filler | Viscosity of Raw Material Slurry | Shrinkage Rate of Sheet | Smoking Flavor | Flavor Retention Rate after Storage |
|---|---|---|---|---|
| Granulated Sugar | ○ | ◎ | X | ◎ |
| Cellulose | ○ | X | X | ○ |
| Calcium Carbonate | ○ | ○ | X X | Δ |
| Starch | X | — | Δ | ○ |
| Pinedex | ○ | ◎ | ○ | ◎ |
| Pinefiber | ○ | ◎ | ◎ | ○ |

—: Not Measured

The evaluation criteria for the "viscosity of raw material slurry" are as follows.

(Evaluation Criteria)

○: Viscosity with which emulsification process can be conducted without problems x: Viscosity with which emulsification process is difficult to conduct The evaluation criteria for the "shrinkage rate of sheet" are as follows.

(Evaluation Criteria)

□: Shrinkage rate of less than 20%

○: Shrinkage rate of 20% or more and less than 50% x: Shrinkage rate of 50% or more

The evaluation criteria for the "smoking flavor" are as follows.

(Evaluation Criteria)

□: Evaluation score 5

○: Evaluation score 4

Δ: Evaluation score 3 x: Evaluation score 2 xx: Evaluation score 1

The evaluation criteria for the "flavor retention rate after storage" are as follows.

(Evaluation Criteria)

□: Evaluation score 4

○: Evaluation score 3

Δ: Evaluation score 2 x: Evaluation score 1

From the results of Example 1, it was found that a substance which plays a role of increasing the bulk of the sheet and satisfies the following requirements (i) and (ii) is effective as a filler:

(i) not increasing the viscosity of the raw material slurry to the extent that preparation of the sheet becomes difficult (i.e., to the extent that kneading and emulsification processes of the raw material slurry become difficult); and (ii) not degrading the flavor retention function of the sheet to the extent that the original functions of the flavor-containing sheet (i.e., functions as a flavor component in the smoking article) are not exhibited.

Furthermore, it was found that a substance that does not affect the smoking flavor of the smoking article is preferable as a filler. In addition, for the filler, it was found that a substance that does not adversely affect the sheet-preparation process is preferable, and for example, a substance that does not act to cause a significant shrinkage of the sheet in the drying process is preferable.

As shown in Table 3, when Pinedex and Pinefiber were used as the candidate fillers, good results were shown for all evaluation items. This result shows that the starch hydrolysate is particularly excellent as a filler. Also, starch is not suitable as a filler, because starch increased the viscosity of raw material slurry to the extent that kneading and emulsification processes of the raw material slurry became difficult. In the case of granulated sugar, cellulose, and calcium carbonate, it is necessary to use them by adjusting the blending amounts while paying attention to the influence on the smoking flavor of the smoking article and the influence on the shrinkage of the sheet, because they play the role of increasing the bulk of the sheet and satisfy the requirements of (i) and (ii) described above.

Example 2

In this example, agar was used as thickening polysaccharide. As in Example 1, the flavor-containing sheet was prepared using the candidate filler, and the evaluation was conducted on how the candidate filler affects the following three evaluation items, "2-1. Viscosity of raw material slurry", "2-2. Shrinkage after drying", and "2-3. Flavor retention rate after storage".

2-1. Viscosity of Raw Material Slurry (1) Preparation of Raw Material Slurry

As there was a difference in the yield of the flavor depending on the types of the candidate filler, in this experiment, the blending amount of the flavor was adjusted for each candidate filler so that the flavor-containing sheet contained about 2.5% by mass of the flavor.

[Sample 16]

For Sample 16, granulated sugar (flavor grade) was used as a candidate filler.

[Composition]

Water: 100 parts by mass

Agar (UP-37; In a Food Industry Co., Ltd.): 5.0 parts by mass

Lecithin (SUN LECITHIN A-1; Taiyo Kagaku Co., Ltd.): 0.1 parts by mass

Candidate filler: 10.4 parts by mass

L-menthol (special grade reagent; Wako Pure Chemical Industries, Ltd.): 0.6 parts by mass

[Procedure]

0.3 L of water containing agar was boiled in a boiling water bath and the agar was sufficiently dissolved in water to prepare an aqueous agar solution. Lecithin, the candidate filler, and 1-menthol were added to the obtained aqueous agar solution, and the mixture was kneaded and emulsified with a homogenizer (DMM type; ATEC Japan) to prepare a raw material slurry.

[Sample 17]

For Sample 17, a raw material slurry was prepared with the same composition and by the same procedure as Sample 16, except that cellulose (cellulose microcrystalline; Sigma-Aldrich) was used as a candidate filler.

[Sample 18]

For Sample 18, a raw material slurry was prepared with the same composition and by the same procedure as Sample 16, except that calcium carbonate (special grade reagent; Wako Pure Chemical Industries, Ltd.) was used as a candidate filler and that the blending amount of 1-menthol was changed to 1.0 part by mass.

[Sample 19]

For Sample 19, a raw material slurry was prepared with the same composition and by the same procedure as Sample 16, except that starch (reagent derived from corn; Wako Pure Chemical Industries, Ltd.) was used as a candidate filler and the blending amount of 1-menthol was changed to 1.0 parts by mass.

[Sample 20]

For Sample 20, a raw material slurry was prepared with the same composition and by the same procedure as Sample 16, except that Pinedex #100 (Matsutani Chemical Industry Co., Ltd.) was used as a candidate filler and that the blending amount of 1-menthol was changed to 1.3 parts by mass.

[Sample 21]

For Sample 21, a raw material slurry was prepared with the same composition and by the same procedure as Sample 16, except that Pinefiber (Matsutani Chemical Industry Co., Ltd.) was used as a candidate filler and that the blending amount of 1-menthol was changed to 8.7 parts by mass.

(2) Preparation of Flavor-Containing Sheet

Using the raw material slurry of each of Samples 16 to 21, a flavor-containing sheet of each of Samples 16 to 21 was prepared in the same manner as in Example 1. The flavor content and the moisture content of each of the obtained flavor-containing sheets of Samples 16 to 21 were measured by the aforementioned measurement method.

The flavor contents of the flavor-containing sheets of Samples 16 to 21 were, respectively, 2.5% by mass, 2.5% by mass, 3.5% by mass, 2.2% by mass, 2.4% by mass, and 4.5% by mass, with respect to the sheet.

(3) Viscosity Measurement of Raw Material Slurry

The viscosity of the raw material slurry of each of Samples 16 to 21 was measured using the same measuring apparatus and measurement conditions as in Example 1.

(4) Results

Figure 4:
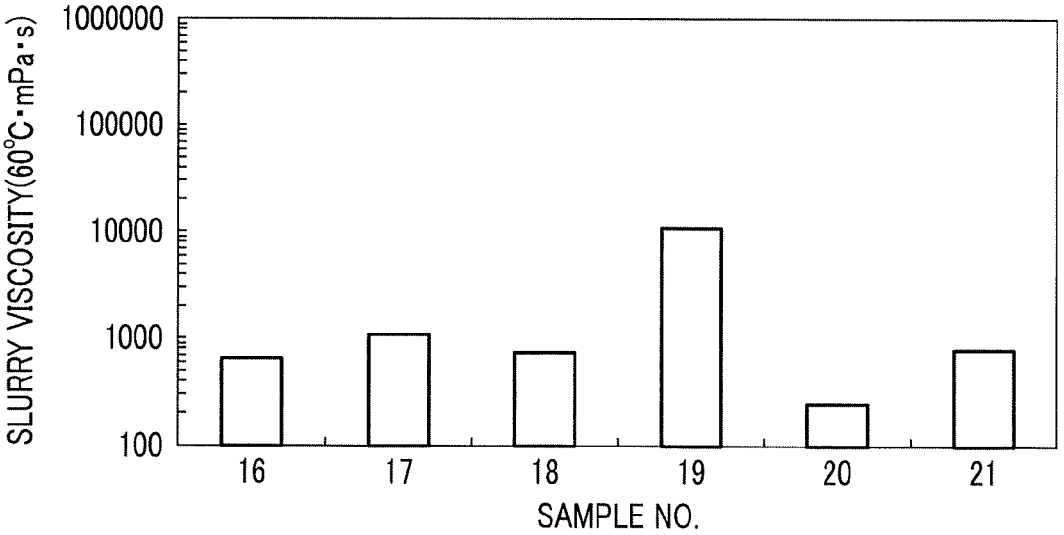
FIG. 4 is a graph showing the viscosity of the raw material slurry when types of the candidate filler are changed.

The results of the viscosity measurement are shown in FIG. 4.

The raw material slurry of each sample had a viscosity to the extent that emulsification and extension processes could be carried out without problems. However, the raw material slurry of Sample 19 (candidate filler: starch) had a tendency of exhibiting the higher viscosity than other candidate fillers as in Example 1.

In addition, the flavor-containing sheet was prepared using the raw material slurry of each of Samples 16 to 21. As a result, the candidate filler played a role of increasing the bulk of the sheet, and therefore it was possible to shorten the drying time required to prepare a sheet having a predetermined thickness and containing a flavor at a low concentration.

2-2. Shrinkage Rate of Sheet (1) Preparation of Flavor-Containing Sheet

Using the raw material slurry of each of Samples 16 to 21, a flavor-containing sheet of each of Samples 16 to 21 was prepared in the same manner as in Example 1.

(2) Measurement of Shrinkage Rate

Using the same method and calculation equation as in Example 1, the shrinkage rate of each of the flavor-containing sheets of Samples 16 to 21 was obtained.

(3) Results

Figure 5:
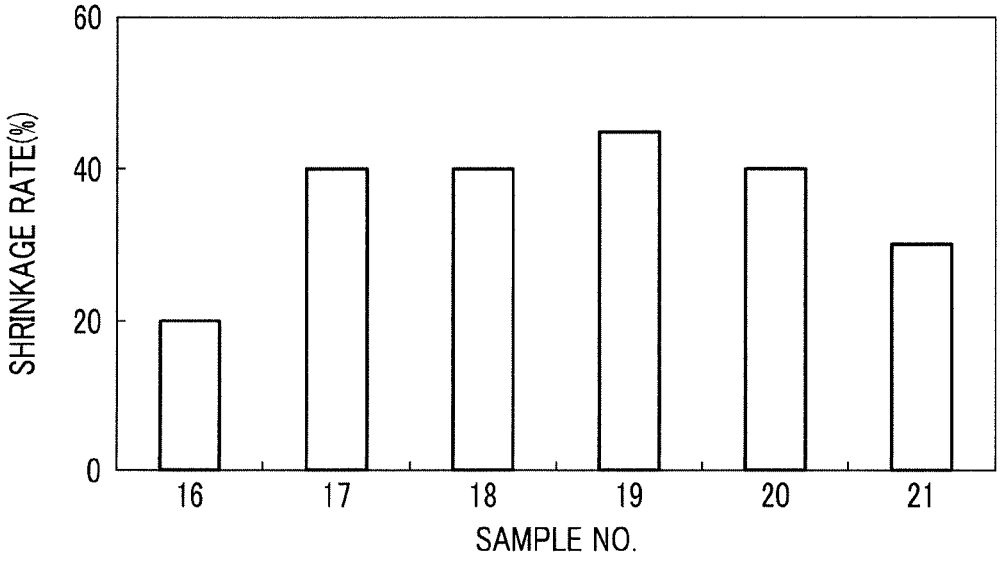
FIG. 5 is a graph showing the shrinkage rate of the flavor-containing sheet when types of the candidate filler are changed.

The measurement results of the shrinkage rate are shown in FIG. 5.

Sample 16 (candidate filler: granulated sugar) had a low shrinkage rate of 20%, and is thus considered to have high manufacturing suitability.

Samples 17 to 21 (candidate fillers: cellulose, calcium carbonate, starch, dextrin and indigestible dextrin) each had a shrinkage rate of about 30 to 40%. This shrinkage rate does not adversely affect the preparation of the sheet, and is a permissible range from the viewpoint of manufacturing suitability.

2-3. Flavor Retention Rate after Storage (1) Preparation of Flavor-Containing Sheet Using the raw material slurry of each of Samples 16 to 21, a flavor-containing sheet of each of Samples 16 to 21 was prepared in the same manner as in Example 1.

(2) Storage Test and Measurement of Flavor Content

For the flavor-containing sheets of Samples 16 to 21, the storage test was conducted in the same manner as in Example 1. In addition, in the same manner as in Example 1, the flavor content of the flavor-containing sheet immediately after preparation and the flavor content of the flavor-containing sheet after storage were measured to calculate the flavor retention rate.

(3) Results

Figure 6:
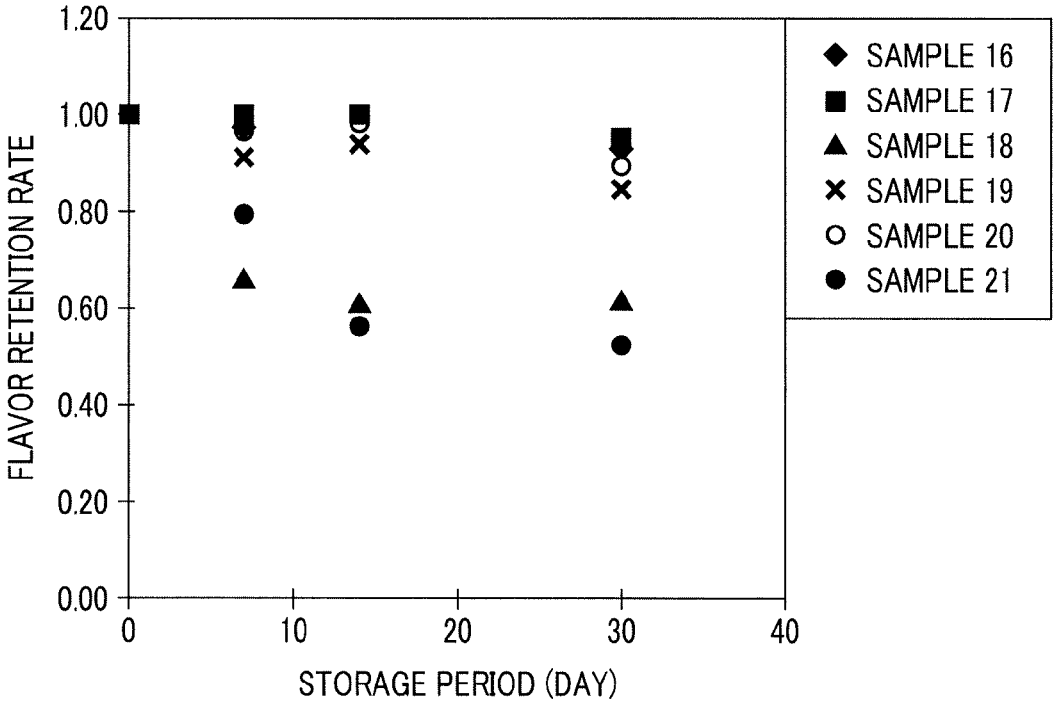
FIG. 6 is a graph showing the flavor retention rate of the flavor-containing sheet when types of the candidate filler are changed.

The results of the flavor retention rate are shown in FIG. 6.

S Based on the flavor retention rate of the flavor-containing sheet stored for 30 days, the evaluation score was given according to the scoring criteria described in Example 1. The evaluation results are shown in the table below.

TABLE 4

| Sample No. | Candidate Filler | Score |
|---|---|---|
| 16 | Granulated Sugar | 4 |
| 17 | Cellulose | 4 |
| 18 | Calcium Carbonate | 3 |
| 19 | Starch | 4 |
| 20 | Pinedex | 4 |
| 21 | Pinefiber | 3 |

According to the results in FIG. 6 and Table 4, the flavor retention rates of the flavor-containing sheets of all samples were 0.5 or more. In particular, the flavor retention rates of the flavor-containing sheets of Samples 16, 17, 19 and 20 were extremely high as 0.75 or more.

2-4. Summary

In Example 2, using agar used as thickening polysaccharide, the evaluation was conducted on how the candidate filler affects the three evaluation items, "2-1. Viscosity of raw material slurry", "2-2. Shrinkage rate of sheet" and "2-3. Flavor retention rate after storage". The evaluation results are summarized in Table 5.

The evaluation criteria for each evaluation item are as described above.

TABLE 5

| Candidate Filler | Viscosity of Raw Material Slurry | Shrinkage Rate of Sheet | Flavor Retention Rate after Storage |
|---|---|---|---|
| Granulated Sugar | ○ | ○ | ◎ |
| Cellulose | ○ | ○ | ◎ |
| Calcium Carbonate | ○ | ○ | ○ |
| Starch | ○ | ○ | ◎ |
| Pinedex | ○ | ○ | ◎ |
| Pinefiber | ○ | ○ | ○ |

The evaluation results of the "viscosity of raw material slurry" and "shrinkage rate of sheet" showed that when agar is used as the thickening polysaccharide, it is possible, as in Example 1, to prepare a flavor-containing sheet including a filler without impediments in preparation. In addition, the evaluation results of the "flavor retention rate after storage" showed that when agar is used as the thickening polysaccharide, a flavor-containing sheet including a filler has a high flavor retention rate after storage, as in Example 1.

These results showed that agar can be used as the thickening polysaccharide in the flavor-containing sheet including the filler, as is the mixture of gellan gum and tamarind gum (Example 1).

Example 3

In this example, the evaluation was conducted on how the blending amount of the candidate filler affects the following five evaluation items, "3-1. Drying time", "3-2. Viscosity of raw material slurry", "3-3. Shrinkage rate of sheet, "3-4. Smoking flavor", and "3-5. Flavor retention rate after storage". In this example, a mixture of Pinedex and Pinefiber (mass ratio of 7:3) was used as a filler.

3-1. Drying Time

The relationship between the blending amount of the filler and the drying time was examined. In this experiment, the filler was blended at a ratio of 0, 100, 200, 300, and 380% by mass with respect to the thickening polysaccharide.

(1) Preparation of Raw Material Slurry

[Sample 22]

[Composition]

Water: 100 parts by mass

Deacylated type gellan gum (KELCOGEL; CP Kelco): 3.0 parts by mass

Tamarind gum (TG-120; MRC Polysaccharide Co., Ltd.): 1.3 parts by mass

Lecithin (SUN LECITHIN A-1; Taiyo Kagaku Co., Ltd.): 0.2 parts by mass

Colorant (cocoa and caramel): 1.0 part by mass

Humectant (glycerin): 0.6 parts by mass

Filler (Pinedex and Pinefiber (mass ratio of 7:3)): 0 part by mass

L-menthol (special grade reagent; Wako Pure Chemical Industries, Ltd.): 0.5 parts by mass

[Procedure]

A raw material slurry was prepared by the same procedure as in Example 1.

[Sample 23]

A raw material slurry was prepared with the same composition and by the same procedure as Sample 22, except that the blending amount of the filler was changed to 4.3 parts by mass (100% by mass with respect to thickening polysaccharide).

[Sample 24]

A raw material slurry was prepared with the same composition and by the same procedure as Sample 22, except that the blending amount of the filler was changed to 8.6 parts by mass (200% by mass with respect to thickening polysaccharide).

[Sample 25]

A raw material slurry was prepared with the same composition and by the same procedure as Sample 22, except that the blending amount of the filler was changed to 12.9 parts by mass (300% by mass with respect to thickening polysaccharide).

[Sample 26]

A raw material slurry was prepared with the same composition and by the same procedure as Sample 22, except that the blending amount of the filler was changed to 16.3 parts by mass (380% by mass with respect to thickening polysaccharide).

(2) Measurement of Drying Time

The raw material slurry of each of Samples 22 to 26 was extended on a stainless steel plate wrapped with Saran Wrap (registered trademark) so that the sheet after drying has a thickness of 0.1 mm. In order to achieve a thickness of 0.1 mm for the dried sheet, it was necessary to appropriately change the thickness of the raw material slurry on the substrate for each sample according to the blending amount of the filler. Specifically, the thicknesses of the raw material slurries of Samples 22 to 26 extended on the substrates were 4.0 mm, 2.2 mm, 1.4 mm, 1.3 mm, and 1.1 mm, respectively.

The extended raw material slurry was once cooled to a sample temperature of 20° C. to form gel. Thereafter, hot air of 100° C. generated by a hot air generator (New Hot Blaster MS 5841-6D; Miyamoto Seisakusho Co., Ltd.) was applied to the gelled raw material for drying to thereby prepare a sheet having a thickness of 0.1 mm. For each sample, the time required for drying was recorded.

(3) Results

Figure 7:
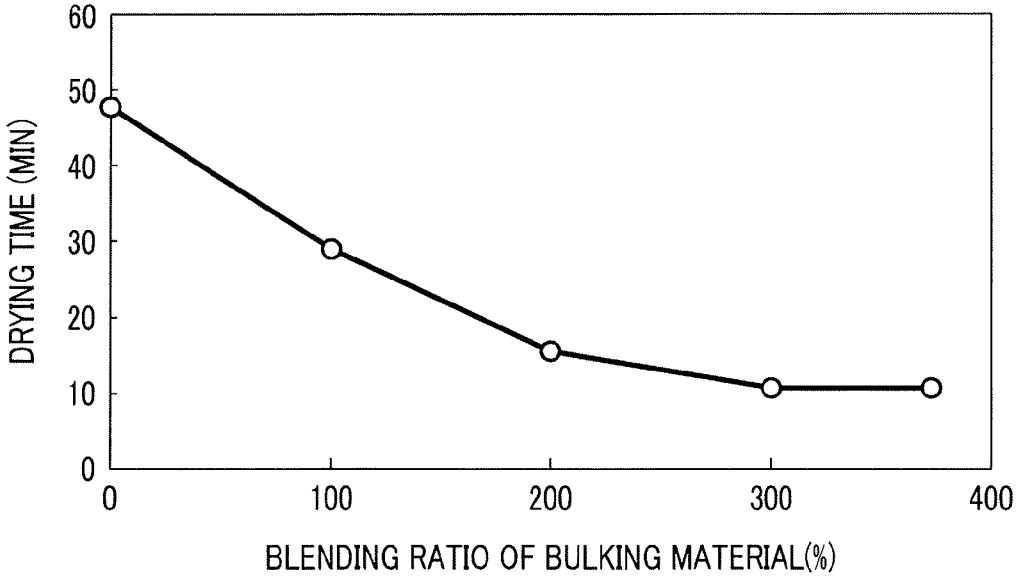
FIG. 7 is a graph showing the relationship between the blending ratio of the filler and the drying time.

FIG. 7 shows the relationship between the blending ratio of the filler and the drying time.

For Samples 23 to 26 containing the filler, it was possible to shorten the drying time required for preparing the flavor-containing sheet, in comparison to Sample 22 containing no filler. In particular, for Samples 24 to 26 containing the filler at a blending ratio of 200% by mass or more with respect to the thickening polysaccharide, the drying time required for preparing the flavor-containing sheet was little, about 10 to 15 minutes. For Samples 25 and 26 containing the filler at a blending ratio of 300% by mass or more with respect to the thickening polysaccharide, the drying time was even shorter, about 10 minutes.

Even if the filler is blended in an amount exceeding 380% by mass with respect to the thickening polysaccharide, it is expected that the sheet can be prepared within a short drying time in the same manner. Therefore, from the viewpoint of cost effectiveness, the content of the filler is preferably from 100 to 500% by mass, more preferably from 200 to 500% by mass, with respect to the thickening polysaccharide.

3-2. Viscosity of Raw Material Slurry

The relationship between the blending amount of the filler and the viscosity of the raw material slurry was examined. In this experiment, the filler was blended at a ratio of 0, 100, 200, 300, 380, 500, 600 and 700% by mass with respect to the thickening polysaccharide. In this experiment, the blending amount of the flavor was adjusted according to the blending amount of the filler in consideration of the yield of the flavor so that all the flavor-containing sheets contained about 2.5% by mass of the flavor.

(1) Preparation of Raw Material Slurry

[Sample 27]

[Composition]

Water: 100 parts by mass

Deacylated type gellan gum (KELCOGEL; CP Kelco): 3.0 parts by mass

Tamarind gum (TG-120; MRC Polysaccharide Co., Ltd.): 1.3 parts by mass

Lecithin (SUN LECITHIN A-1; Taiyo Kagaku Co., Ltd.): 0.2 parts by mass

Colorant (cocoa and caramel): 1.0 part by mass

Humectant (glycerin): 0.6 parts by mass

Filler (Pinedex and Pinefiber (mass ratio of 7:3)): 0 part by mass

L-menthol (special grade reagent; Wako Pure Chemical Industries, Ltd.): 1.4 parts by mass

[Procedure]

A raw material slurry was prepared by the same procedure as in Example 1.

[Sample 28]

A raw material slurry was prepared with the same composition and by the same procedure as Sample 27, except that the blending amount of the filler was changed to 4.3 parts by mass (100% by mass with respect to thickening polysaccharide) and that the blending amount of 1-menthol was changed to 3.7 parts by mass.

[Sample 29]

A raw material slurry was prepared with the same composition and by the same procedure as Sample 27, except that the blending amount of the filler was changed to 8.6 parts by mass (200% by mass with respect to thickening polysaccharide) and that the blending amount of 1-menthol was changed to 4.8 parts by mass.

[Sample 30]

A raw material slurry was prepared with the same composition and by the same procedure as Sample 27, except that the blending amount of the filler was changed to 12.9 parts by mass (300% by mass with respect to thickening polysaccharide) and that the blending amount of 1-menthol was changed to 5.8 parts by mass.

[Sample 31]

A raw material slurry was prepared with the same composition and by the same procedure as Sample 27, except that the blending amount of the filler was changed to 16.3 parts by mass (380% by mass with respect to thickening polysaccharide) and that the blending amount of 1-menthol was changed to 5.2 parts by mass.

[Sample 32]

A raw material slurry was prepared with the same composition and by the same procedure as Sample 27, except that the blending amount of the filler was changed to 21.5 parts by mass (500% by mass with respect to thickening polysaccharide) and that the blending amount of 1-menthol was changed to 6.5 parts by mass.

[Sample 33]

A raw material slurry was prepared with the same composition and by the same procedure as Sample 27, except that the blending amount of the filler was changed to 25.8 parts by mass (600% by mass with respect to thickening polysaccharide) and that the blending amount of 1-menthol was changed to 7.6 parts by mass.

[Sample 34]

A raw material slurry was prepared with the same composition and by the same procedure as Sample 27, except that the blending amount of the filler was changed to 30.1 parts by mass (700% by mass with respect to thickening polysaccharide) and the blending amount of 1-menthol was changed to 7.6 parts by mass.

(2) Preparation of Flavor-Containing Sheet

Using the raw material slurry of each of Samples 27 to 34, a flavor-containing sheet was prepared in the same manner as in Example 1. The flavor content and the moisture content of each of the obtained flavor-containing sheets of Samples 27 to 34 were measured by the measurement method described above.

The flavor contents of the flavor-containing sheets of Samples 27 to 34 were, respectively, 3.5% by mass, 2.8% by mass, 3.9% by mass, 3.5% by mass, 2.3% by mass, 2.9% by mass, 2.9% by mass, and 2.5% by mass, with respect to the sheet.

(3) Viscosity Measurement of Raw Material Slurry

The viscosity of the raw material slurry of each of Samples 27 to 34 was measured using the same measuring apparatus and measurement conditions as in Example 1.

(4) Results

Figure 8:
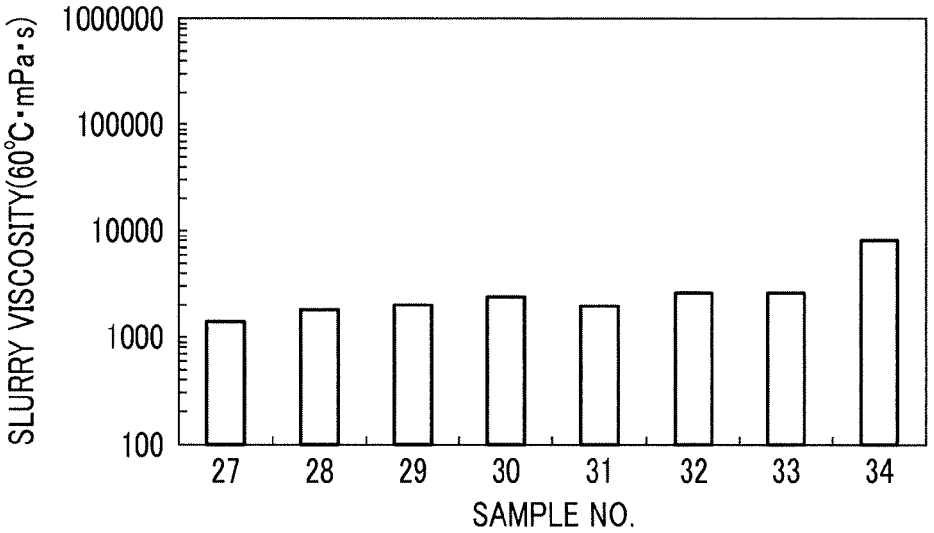
FIG. 8 is a graph showing the viscosity of the raw material slurry when the blending ratio of the filler is changed.

The results of the viscosity measurement are shown in FIG. 8.

The raw material slurry of each sample had a viscosity to the extent that emulsification and extension processes could be carried out without problems. These results indicate that the viscosity of the raw material slurry is not significantly increased even if the blending amount of the mixture of Pinedex and Pinefiber used as the filler is increased to 7 times the amount of the thickening polysaccharide.

3-3. Shrinkage Rate of Sheet (1) Preparation of Flavor-Containing Sheet

Using the raw material slurry of each of Samples 27 to 34, a flavor-containing sheet of each of Samples 27 to 34 was prepared in the same manner as in Example 1.

(2) Measurement of Shrinkage Rate

Using the same method and calculation equation as in Example 1, the shrinkage rate of each of the flavor-containing sheets of Samples 27 to 34 was obtained.

(3) Results

Figure 9:
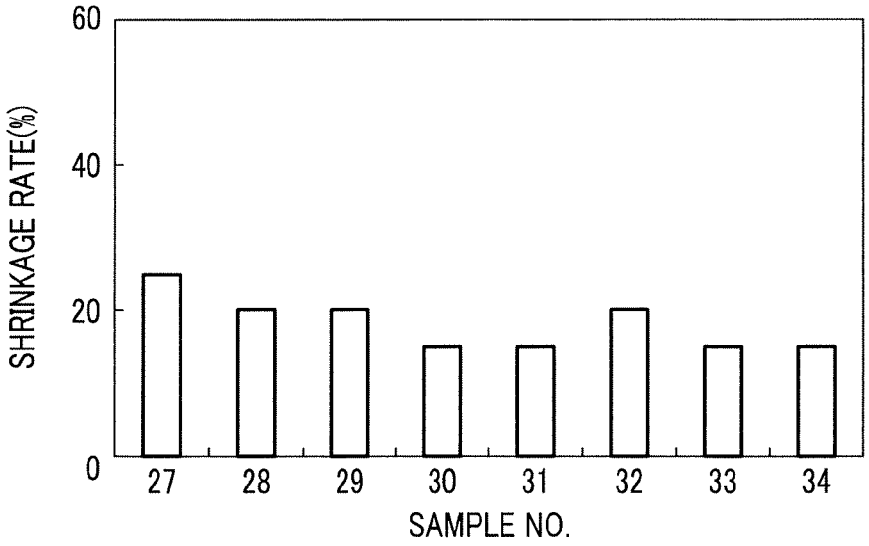
FIG. 9 is a graph showing the shrinkage rate of the flavor-containing sheet when the blending ratio of the filler is changed.

The measurement results of the shrinkage rate are shown in FIG. 9.

The shrinkage rates of the flavor-containing sheets of all samples were about 10 to 20%, causing no impediment to preparation. The results indicate that the shrinkage rate of the sheet is not increased even if the blending amount of the mixture of Pinedex and Pinefiber used as the filler is increased to 7 times the amount of thickening polysaccharide.

3-4. Smoking Flavor

Using the flavor-containing sheets of Sample 27 and Samples 30 to 34, cigarettes were prepared as follows.

(1) Preparation of Cigarette

The flavor-containing sheet (thickness 0.1 mm) of Sample 27 was cut to obtain cut pieces each having a long side of 4 mm and a short side of 1.5 mm. The cut pieces were mixed with cut tobacco taken from the MEVIUS SUPERLIGHTS Tar 6 mg product (Japan Tobacco Inc.) at a mass ratio of 5:95 to obtain mixed cut tobacco. The mixed cut tobacco was rewrapped with a cigarette paper to prepare a cigarette of Sample 27.

Using the flavor-containing sheets of Samples 30 to 34, cigarettes of Samples 30 to 34 were prepared in a similar manner.

(2) Sensory Evaluation of Smoking Flavor

The smoking flavor of each of the cigarettes of Sample 27 and Samples 30 to 34 was evaluated by sensory evaluation. Specifically, the evaluation was conducted on the extent to which the smoking flavor of each of the cigarettes of Samples 30 to 34 had changed in comparison to the smoking flavor of the cigarette of Sample 27 (containing no filler).

Eight panelists trained in evaluating the smoking flavors smoked the cigarettes of Samples 27 and Samples 30 to 34 with the lot names hidden, and scored 1 to 5 which reflected the extent of the change in the smoking flavor from that of Sample 27.

The scoring criteria and the method of calculating the evaluation score are as described in Example 1.

(3) Results

The evaluation scores are shown in Table 6 below.

TABLE 6

| Sample No. | Blending Amount of Filler (Mass %) | Score |
|---|---|---|
| 30 | 300 | 5 |
| 31 | 380 | 4 |
| 32 | 500 | 4 |
| 33 | 600 | 3 |
| 34 | 700 | 2 |

The cigarettes of Samples 30 to 32 demonstrated little or no change in the smoking flavor in comparison to the cigarette of Sample 27. The cigarette of Sample 33 demonstrated a smoking flavor which had changed from that of the cigarette of Sample 27. The cigarette of Sample 34 demonstrated a smoking flavor which had changed considerably from that of the cigarette of Sample 27.

These results indicate that if the blending amount of the filler increases, there is a large change in the smoking flavor, whereas if the filler is blended in an amount of up to 500% by mass with respect to the thickening polysaccharide, there is almost no change in the smoking flavor.

3-5. Flavor Retention Rate after Storage (1) Preparation of Flavor-Containing Sheet Using the raw material slurry of each of Samples 27 to 34, a flavor-containing sheet of each of Samples 27 to 34 was prepared in the same manner as in Example 1.

(2) Storage Test and Measurement of Flavor Content

For the flavor-containing sheets of Samples 27 to 34, the storage test was conducted in the same manner as in Example 1. In addition, in the same manner as in Example 1, the flavor content of the flavor-containing sheet immediately after preparation and the flavor content of the flavor-containing sheet after storage were measured to calculate the flavor retention rate.

(3) Results

Figure 10:
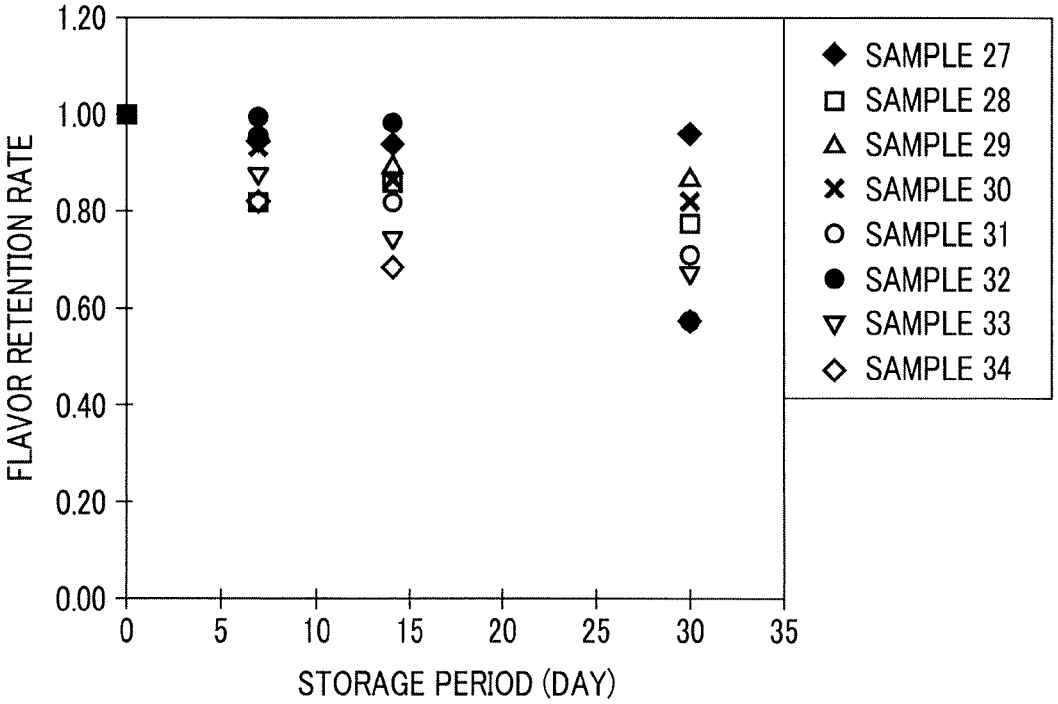
FIG. 10 is a graph showing the flavor retention rate of the flavor-containing sheet when the blending ratio of the filler is changed.

The results of the flavor retention rate are shown in FIG. 10.

Based on the flavor retention rate of the flavor-containing sheet stored for 30 days, the evaluation score was given according to the scoring criteria described in Example 1. The evaluation results are shown in the table below.

TABLE 7

| Sample No. | Blending Amount of Filler (Mass %) | Score |
|---|---|---|
| 27 | 0 | 4 |
| 28 | 100 | 4 |
| 29 | 200 | 4 |
| 30 | 300 | 4 |
| 31 | 380 | 3 |
| 32 | 500 | 3 |
| 33 | 600 | 3 |
| 34 | 700 | 3 |

—: Not Measured

According to the results in FIG. 10 and Table 7, the flavor retention rates of the flavor-containing sheets of all samples measured were 0.5 or more. In particular, the flavor retention rates of the flavor-containing sheets of Samples 28, 29 and 30 were extremely high, 0.75 or more.

3-6. Summary

In Example 3, the evaluation was conducted on how the blending amount of the candidate filler affects the following five evaluation items, "3-1. Drying time", "3-2. Viscosity of raw material slurry", "3-3. Shrinkage rate of sheet, "3-4. Smoking flavor", and "3-5. Flavor retention rate after storage". The evaluation results are summarized in Table 8.

TABLE 8

| Blending Amount of Filler (Mass %) | Drying Time | Viscosity of Raw Material Slurry | Shrinkage Rate of Sheet | Smoking Flavor | Flavor Retention Rate after Storage |
|---|---|---|---|---|---|
| 0 | X | ○ | ○ | — | ◎ |
| 100 | ○ | ○ | ○ | — | ◎ |
| 200 | ◎ | ○ | ○ | — | ◎ |
| 300 | ◎ | ○ | ◎ | ◎ | ◎ |
| 380 | ◎ | ○ | ◎ | ○ | ○ |
| 500 | — | ○ | ○ | ○ | ○ |
| 600 | — | ○ | ◎ | Δ | ○ |
| 700 | — | ○ | ◎ | X | ○ |

—: Not Measured

The evaluation criteria for the "drying time" are as follows.

(Evaluation Criteria)

□: Less than 20 minutes

○: 20 minutes or more and less than 30 minutes

Δ: 30 minutes or more and less than 40 minutes x: 40 minutes or more

The evaluation criteria for other evaluation items are as described in Example 1.

As shown in Table 8, for the evaluation items of the "viscosity of raw material slurry", "shrinkage rate of sheet" and "flavor retention rate after storage", no significant influence from the blending amount of the filler was observed. For the evaluation item of the "smoking flavor", on the other hand, it was found that there is a large change in the smoking flavor as the blending amount of the filler increases, and that the upper limit of the blending amount of the filler is preferably 500% by mass with respect to the blending amount of the thickening polysaccharide. For the evaluation item of "drying time", it was found that the drying time tends to increase as the amount of the filler is reduced, and that the lower limit of the blending amount of the filler is preferably 100% by mass or more, more preferably 200% by mass or more, with respect to the blending amount of the thickening polysaccharide.

According to these results and from the viewpoint of cost effectiveness, it is found that the content of the filler in the sheet is preferably 100 to 500% by mass, more preferably 200 to 500% by mass, with respect to the mass of the thickening polysaccharide.

Example 4

In this example, the relationship between the blending amount of the cut pieces of the flavor-containing sheet and the blending uniformity was examined. Specifically, the cigarette rod including the cut pieces of the flavor-containing sheet was divided into five equal parts to prepare cigarette rod fragments, and the degree of variation in the flavor content among the cigarette rod fragments was calculated as a variation coefficient (%).

(1) Preparation of Cigarette

A flavor-containing sheet (thickness 0.1 mm) was prepared with the same composition and by the same procedure as the flavor-containing sheet of Sample 1. The prepared flavor-containing sheet was cut to obtain cut pieces each having a long side of 4 mm and a short side of 1.5 mm. The obtained cut pieces were mixed with cut tobacco taken from the MEVIUS SUPERLIGHTS to prepare a tobacco filler. The cut pieces were blended at ratios of 2.5% by mass, 5% by mass, 7.5% by mass, and 10% by mass with respect to the tobacco filler, to prepare the tobacco filler. The tobacco filler was wrapped with a cigarette paper to prepare a cigarette rod.

(2) Measurement of Flavor Content

The prepared cigarette rod was divided into five equal parts to obtain cigarette rod fragments. The amount of menthol contained in each cigarette rod fragment was measured by GC-MSD as described in Example 1.

(3) Evaluation of Variation in Flavor Content

Based on the amount of menthol measured, the variation coefficient (%) of the flavor content was calculated for each cigarette rod. Based on the obtained variation coefficient, variation in the distribution of the flavor in each cigarette rod was evaluated.

(4) Results

Figure 11:
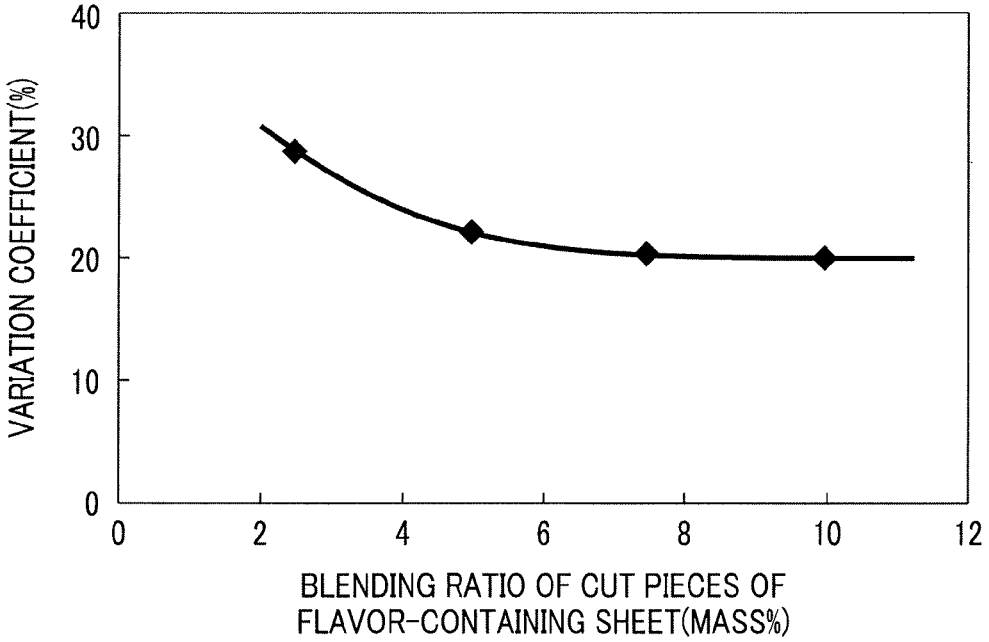
FIG. 11 is a graph showing the relationship between the blending ratio of cut pieces of the flavor-containing sheet and the variation coefficient of the flavor content.

FIG. 11 shows the relationship between the blending ratio of the cut pieces of the flavor-containing sheet and the variation coefficient of the flavor content.

When the cut pieces of the flavor-containing sheet were included at ratios of 5% by mass, 7.5% by mass, and 10% by mass with respect to the tobacco filler, the variation coefficient of the flavor content was low. From the results shown in FIG. 11, it is assumed that the cut pieces of the flavor-containing sheet can be uniformly blended in the cigarette rod if 4% by mass or more of the cut pieces are blended.

Furthermore, when 7.5% by mass of the cut pieces of the flavor-containing sheet was blended and 10% by mass thereof was blended, the variation coefficient of the flavor content was almost the same. Therefore, the cut pieces of the flavor-containing sheet may be blended in an amount of more than 10% by mass, but from the viewpoint of cost effectiveness, it is preferable to blend them in an amount of, for example, 10% by mass or less, at most 20% by mass or less.

The results show that when the cut pieces of the flavor-containing sheet are incorporated in the smoking article in an amount of 4 to 20% by mass with respect to the total mass of the cut tobacco and the cut pieces, the cut pieces are uniformly distributed in the cigarette rod, and it is possible to provide the flavor in a stable manner during the smoking period.

What is claimed is:

1. A flavor-containing sheet for a smoking article, the sheet comprising a thickening polysaccharide, a flavor, an emulsifier, and a starch hydrolysate having a DE value within a range of 2 to 20, wherein a content of the flavor is less than 18% by mass with respect to the flavor-containing sheet, a blending amount of the thickening polysaccharide is 10 to 35% by mass with respect to a total mass of constituent components other than water in a raw material of the flavor-containing sheet, and a content of the starch hydrolysate is 100 to 500% by mass with respect to the thickening polysaccharide.

2. The flavor-containing sheet according to claim 1, wherein the starch hydrolysate is selected from the group consisting of dextrin having a DE value of 2 to 5, indigestible dextrin having a DE value of 10 to 15, and a mixture thereof.

3. The flavor-containing sheet according to claim 1, wherein a content of the starch hydrolysate is 200 to 500% by mass with respect to the thickening polysaccharide.

4. The flavor-containing sheet according to claim 1, wherein the flavor-containing sheet has a thickness of 0.05 to 0.15 mm.

5. The flavor-containing sheet according to claim 1, wherein the thickening polysaccharide is selected from the group consisting of gellan gum; a mixture of gellan gum and tamarind gum; and agar.

6. The flavor-containing sheet according to claim 1, wherein a content of the emulsifier is 0.5 to 5% by mass with respect to the thickening polysaccharide.

7. The flavor-containing sheet according to claim 1, wherein the sheet comprises less than 10% by mass of water with respect to the flavor-containing sheet.

8. A smoking article comprising cut pieces of the flavor-containing sheet according to claim 1.

9. The smoking article according to claim 8, wherein the article further comprises a cut tobacco, and the cut pieces of the flavor-containing sheet are mixed with the cut tobacco.

10. The smoking article according to claim 9, wherein the cut pieces are cut pieces of the flavor-containing sheet having a thickness of 0.05 to 0.15 mm, and the cut pieces each have a long side of 2.0 to 7.0 mm and a short side of 0.5 to 2.0 mm.

11. The smoking article according to claim 9, wherein the cut pieces are contained in an amount of 4 to 20% by mass with respect to a total mass of the cut tobacco and the cut pieces.

* * * * *